US007264037B2

(12) United States Patent
Kuroki et al.

(10) Patent No.: US 7,264,037 B2
(45) Date of Patent: Sep. 4, 2007

(54) MOLDING OF SLURRY-FORM SEMI-SOLIDIFIED METAL

(75) Inventors: Koichi Kuroki, Sayama (JP); Takeshi Masaki, Sayama (JP); Hideaki Onda, Sayama (JP); Shinji Kazama, Sayama (JP); Tetsuya Muramatsu, Sayama (JP); Tetsuji Umemoto, Sayama (JP); Kenji Ohwada, Sayama (JP); Tomonori Taoka, Sayama (JP); Akira Noda, Sayama (JP); Hiromichi Baba, Sayama (JP); Kenichi Yasuda, Sayama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/562,457

(22) PCT Filed: Jun. 29, 2004

(86) PCT No.: PCT/JP2004/009507

§ 371 (c)(1),
(2), (4) Date: Dec. 29, 2005

(87) PCT Pub. No.: WO2005/002760

PCT Pub. Date: Jan. 13, 2005

(65) Prior Publication Data

US 2006/0151137 A1 Jul. 13, 2006

(30) Foreign Application Priority Data

| | | |
|---|---|---|
| Jul. 2, 2003 | (JP) | 2003-190305 |
| Mar. 23, 2004 | (JP) | 2004-085568 |
| Mar. 23, 2004 | (JP) | 2004-085569 |
| May 25, 2004 | (JP) | 2004-154666 |
| Jun. 8, 2004 | (JP) | 2004-169326 |

(51) Int. Cl.
*B22D 27/08* (2006.01)
*B22D 17/08* (2006.01)
*B22D 23/00* (2006.01)
*B22D 25/00* (2006.01)

(52) U.S. Cl. ..... 164/71.1; 164/113; 164/121; 164/158; 164/312; 164/900

(58) Field of Classification Search ..... 164/71.1, 164/113, 900, 121, 158, 312
See application file for complete search history.

(56) References Cited

U.S. PATENT DOCUMENTS 4,108,643 A * 8/1978 Flemings et al. ..... 148/400

(Continued)

FOREIGN PATENT DOCUMENTS

JP 04-124233 4/1992

(Continued)

*Primary Examiner*—Kuang Y. Lin
(74) *Attorney, Agent, or Firm*—Rankin, Hill, Porter & Clark LLP

(57) ABSTRACT

Made up of a step of preparing a map expressing a correlation between solid phase percentage and viscosity of a slurry-form semi-solid metal (27) for a given metal composition; a step of setting a target viscosity corresponding to a target solid phase percentage using this map; a viscosity measuring step of measuring the viscosity of a semi-solid metal in a vessel (13) while cooling it; and a step of carrying out cooling until this viscosity reaches the target viscosity, by these steps being carried out in from the preparation of the map expressing the correlation between solid phase percentage and viscosity of the semi-solid metal to the end of cooling of the semi-solid metal the solid phase percentage of the semi-solid metal is made to match the target solid phase percentage. Because the viscosity is detected, the affects of cooling rate changes and time can be eliminated, and it is possible to raise management accuracy of the solid phase percentage of the semi-solid metal much further than with related art management based on time.

23 Claims, 31 Drawing Sheets

U.S. PATENT DOCUMENTS 5,144,998 A * 9/1992 Hirai et al. ..... 164/71.1

FOREIGN PATENT DOCUMENTS

| | | |
|---|---|---|
| JP | 07-155919 | 6/1995 |
| JP | 10-211565 | 8/1998 |
| JP | 63-256257 | 10/1998 |
| JP | 11-197815 | 7/1999 |
| JP | 2002-153945 | 5/2002 |
| JP | 2002-303573 | 10/2002 |

* cited by examiner

MOLDING OF SLURRY-FORM SEMI-SOLIDIFIED METAL

TECHNICAL FIELD

This invention relates to the manufacture of a die cast molding using a slurry-form semi-solid metal such as an aluminum alloy.

BACKGROUND ART

Technology for die cast molding a metal melt such as an aluminum alloy is currently widely used, and recently, die casting methods using slurry-form semi-solid metal in which solid and liquid are both present together, regarded as suited to increasing mold life and increasing the dimensional accuracy of die cast moldings, have been receiving attention.

In a die casting method using a semi-solid metal, management of solid phase percentage, which expresses the ratio of solid to liquid in the molten alloy, is important. In inventions pertaining to this solid phase percentage management, for example a method wherein a target solid phase percentage is sought to be obtained by temperature management up to the transformation point of the semi-solid metal and then for a fixed time from the transformation point performing time management of stirring and cooling is known in JP-A-2002-153945.

FIG. 35 shows with a flow chart a method for obtaining a target solid phase percentage set forth in JP-A-2002-153945.

First, a control start time Ts is inputted. Then, stirring and cooling of a semi-solid metal in a vessel is started, and a semi-solid metal temperature measured with a thermocouple is read in.

Here, the elapsed time from the start of cooling is written Time, and until this elapsed time Time reaches a time Ts, stirring and cooling are continued and reading in of the semi-solid metal temperature is continued. When the elapsed time Time reaches the time Ts, the process moves on to a next step ST05.

ST05 estimates a transition point Pt from a cooling curve. ST06 obtains a cooling time Tf corresponding to the transition point Pt, i.e. a cooling time to a target solid phase percentage being reached from the transition point Pt. ST07 ends the stirring and cooling when the cooling time after the transition point Pt has reached Tf, and then die casting is promptly started.

FIG. 36 shows the method for obtaining a target solid phase percentage set forth in JP-A-2002-153945 with a graph, and supplements ST07 of FIG. 35. It assumes that the target solid phase percentage can be reached by stirring for the cooling time Tf from the transition point Pt of the semi-solid metal.

In this JP-A-2002-153945, it is taken as a premise that the cooling rate does not change around the transition point.

However, generally the properties of a metal change around its transition point, and inevitably a difference arises between the cooling rate before the transition point and the cooling rate after the transition point.

This difference appears as a difference between the target solid phase percentage and the actual solid phase percentage, and as a result the solid phase percentage management accuracy falls.

In recent years, along with a demand for higher-level casting technology, it has become necessary to raise solid phase percentage management accuracy of semi-solid metals. So, management technology to replace the time-based solid phase percentage management of related art is awaited.

In related art, as a production line of a metal molding made by die cast molding of this kind, one having a vessel capable of receiving a predetermined amount of melt, a semi-solid metal production apparatus for making a semi-solid metal by stirring and cooling melt in the vessel, a molding machine for molding a metal molded product with semi-solid metal as a starting material, a carrying apparatus consisting of a multiple joint robot for carrying the vessel from the semi-solid metal production apparatus to the molding machine and feeding the semi-solid metal in the vessel into the molding machine, and a vessel restoring apparatus for carrying out a predetermined restoring treatment on the vessel having been emptied by the pouring of the semi-solid metal into the molding machine, is known for example in JP-A-2001-170765.

In this technology, the vessel restoring apparatus has air blowing means for removing metal adhered to the inside of the vessel while cooling the vessel by blowing air at the inside of the vessel, and coating means for applying releasing agent to the inside of the vessel.

A line in which in addition to air blowing means and coating means, brushing means for cleaning the inside of the vessel with a brush after the treatment with the air blowing means is added to the vessel restoring apparatus is known, for example in JP-A-2002-336946.

The air blowing means of these vessel restoring apparatuses of related art act so as to solidify semi-solid metal remaining adhered to the inner face of the vessel into a granular form and blow it off, but when semi-solid metal remains in relatively large lumps, it is difficult to solidify and blow these off. When semi-solid metal has remained and solidified in large lumps, it is not possible to remove these by brushing means either, and the frequency of adhered metal remaining in the vessel becomes high. Because of this, in related art, the presence or absence of adhered metal in the vessel is checked visually after the restoring treatment of the vessel restoring apparatus, and when adhered metal remains, the vessel is removed to outside the line and work to remove the adhered metal is carried out. As a result, it becomes necessary to anticipate restoring work outside the line and prepare a larger number of vessels, and this leads to an increase in initial cost.

And, for the production of semi-solid metal, temperature management of the vessel is important, and it is necessary for the vessel to be cooled to a predetermined temperature with air blowing means. However, when semi-solid metal remains inside the vessel in relatively large lumps, the vessel does not readily cool, the cooling of the vessel takes time, and this constitutes a problem in achieving productivity increases.

Thus, a metal molded product manufacturing line on which even if semi-solid metal remains in a vessel in relatively large lumps this can be efficiently removed and the problems described above are resolved has been awaited.

Also, as a production line of a metal molded product of related art, one having a semi-solid metal production apparatus for making a semi-solid metal by cooling and stirring a melt received in a vessel with a stirring head having a cooling metal that is immersed in the melt, wherein the vessel is carried from the semi-solid metal production apparatus to a molding machine and semi-solid metal in the vessel is fed into the molding machine, is known.

Here, when semi-solid metal adheres to a cooling metal of the stirring head and the next production of semi-solid metal is carried out with it still left there, solid matter having adhered to the cooling metal and solidified detaches in the vessel and quality deterioration of the semi-solid metal occurs, and plant trouble of solidified matter interfering with the vessel and so on arises. To avoid this, in related art, a line in which a stirring head restoring apparatus is disposed adjacent to the semi-solid metal production apparatus and carries out a predetermined restoring treatment on the stirring head after the production of the semi-solid metal is known, for example in JP-A-2002-336946. This stirring head restoring apparatus has cooling means for cooling the cooling metal of the stirring head by dipping it in water and coating means for applying a releasing agent to the cooling metal. When the cooling metal is dipped in water by the cooling means, the water flash-boils, and the energy of the flash-boiling causes adhered metal to detach and fall from the cooling metal.

One has been proposed in which in addition to the cooling metal a probe for measuring viscosity is attached to the stirring head, and the probe is immersed in the melt in the vessel together with the cooling metal and production of the semi-solid metal is carried out so that the viscosity value measured by the probe reaches a target value.

When a probe is attached to the stirring head like this, semi-solid metal adheres to the probe also. It was thought that when the probe was dipped in water together with the cooling metal by the cooling means of the stirring head restoring apparatus described above, adhered metal would detach and fall from the probe under the energy of flash-boiling of the water; however, in practice, because compared to a cooling metal the heat capacity of a probe is extremely small, the energy of the flash-boiling around the probe is not strong enough for the adhered metal to detach and fall, and the adhered metal tended to remain on the probe. And, the probe remains immersed in the water until the cooling metal has been cooled to the optimal temperature, and with this the problem also arises that the temperature of the probe, which has a small heat capacity, falls too far, and it is difficult for the releasing agent applied to dry in the subsequent coating step.

So, a stirring head restoring apparatus and restoring method of a semi-solid metal production apparatus have been awaited with which, in the restoring treatment of a stirring head fitted with a probe, metal adhered to the probe can be removed efficiently and excessive cooling of the probe can also be prevented.

Also, in related art, slurry-form semi-solid metal injection-molding technology is known, for example in JP-A-2002-336946.

Technology set forth in JP-A-2002-336946 will now be explained on the basis of the next figure.

FIG. 37 shows technology set forth in JP-A-2002-336946. The S1 to S11 below denote a step 1 to a step 11.

First, in S1, 1 shot of melt is received into a ladle from a melt holding furnace.

Then, in S2, the ladle is carried to a stirring station, and there is transferred to a first vessel.

In S3, the melt in the first vessel is stirred at the stirring station, brought to a state wherein both solid and liquid are present, and brought to a desired solid phase percentage. The temperature at this time is uniform.

Next, in S4 the first vessel is carried to an injection-molding machine.

Meanwhile, in S5, closing of a mold is carried out in parallel at the injection-molding machine.

Then, in S6, melt is poured from the first vessel into an injection sleeve, and in S7 injection into the mold is carried out.

In S8 air is blown at the emptied first vessel, in S9 the inside of the first vessel is cleaned by a brushing treatment, and in S10 coating of the inside of the first vessel is carried out.

In S11, if the number of moldings manufactured has reached a predetermined number, production is ended. If it has not, the process returns to S1 and production continues.

Now, because the semi-solid metal is a mixture of solid phase and liquid phase, management of its solid phase percentage (=solid phase/(liquid phase+solid phase) %) is important. This is because if the solid phase percentage differs, the quality of the molding obtained changes.

In S3 of FIG. 37, the melt in the first vessel is stirred with a cooling metal and, due to a heat-removing action that accompanies this stirring, cooling proceeds and the viscosity of the melt rises and its solid phase percentage rises.

Therefore, in the management of the solid phase percentage, the stirring of the melt becomes important.

However, in the related art technology mentioned above, when manufacturing was carried out to obtain multiple moldings with a fixed solid phase percentage, the stirring time required varied greatly.

When the stirring time is extremely long, because the time for which the injection-molding machine is kept waiting becomes too long, productivity falls. When the stirring time is extremely short, because the injection-molding machine becomes unable to keep up, it is necessary to limit the number of vessels circulated, and productivity falls.

That is, to circulate multiple vessels optimally and operate the injection-molding machine well, it is necessary to minimize variations in stirring time.

So, technology has been awaited with which, in semi-solid metal injection-molding, it is possible to suppress variations in the duration of stirring carried out to keep the solid phase percentage of the melt constant.

Products manufactured using die casting include for example a cylinder block of an engine. A water jacket serving as a cooling water passage is provided in this cylinder block, and there are an open deck type, in which the water jacket opens at the cylinder head face; a closed deck type, in which the water jacket is closed; and a semi-closed deck type, in which part of the water jacket is open at the cylinder head face. Because at the cylinder head face the cylinder bores and the cylinder outer wall parts are connected, cylinder blocks of the closed deck type and the semi-closed deck type are highly rigid, suffer little deformation, and moreover have long life. Because in these closed deck type and semi-closed deck type cylinder blocks the water jacket is of a closed shape, at the time of casting it is not possible to use a durable trimming die for the water jacket, and a breakable core that can be crumbled and removed after casting, for example a sand core, is used.

On the other hand, the cylinder block is a main constituent part of the engine, and because heat and pressure act upon it it is also an important part strengthwise. Therefore, when a cylinder block is cast, it is desirable that the occurrence of nesting be suppressed. As one means for preventing nesting, there is the example of using a slurry-form semi-solid metal as the casting material. A semi-solid metal is a metal in a state such that solid and liquid are present together, and because its viscosity is high there is little entrainment of gas and the occurrence of nesting can be kept down.

As related existing technology, in JP-B55-19704, a die casting method is set forth wherein the occurrence of surge is suppressed by the piston being stopped just before the melt is completely injected into a cavity having a sand core.

In JP-A-9-57415, a method is set forth wherein the speed of the melt at a weir at the time of melt injection is made a low speed of 1/5 to 1/50 of that in an ordinary die casting method.

In JP-A-11-104802, a die casting method is set forth wherein a slurry-form semi-solid metal is prevented from penetrating a core by the average particle size of its solid phase part being adjusted.

Now, a slurry-form semi-solid metal has intermediate properties between a liquid and a solid, and compared to a liquid its viscosity is high. Consequently, if a semi-solid metal is made to impact a sand core at a high speed, there is a risk of the sand core breaking. In particular, a thin sand core for forming something like a water jacket will readily break when hit by a highly viscous semi-solid metal and yield of the product will fall. Because a sand core must be removed after casting, it is desirable that it crumble easily, and it cannot be made too hard.

To prevent breakage of a sand core during casting it is conceivable to lower the speed at which the semi-solid metal is poured, but when pouring takes a long time the semi-solid metal hardens, or as a result of its temperature falling its solid phase percentage changes, and there is a risk of the required run ability not being obtained. As a result of the temperature falling the viscosity of the semi-solid metal becomes still higher, and again there is a risk of breaking the sand core.

In the method set forth in the above-mentioned JP-B-55-19704, although the piston is stopped just before the melt has filled the volume inside a cavity having a sand core and surging is thereby suppressed, when it hits the sand core the melt is at a high speed. If it were an ordinary melt, even when impacted at a high speed the sand core would not break; but when a semi-solid metal hits it at high speed there is a risk of it breaking, as mentioned above. And when as in JP-A-9-57415 the pouring speed is made extremely low, the pouring time becomes long, and although with an ordinary melt there is no problem, with a semi-solid metal there is the concern that it will harden or its run ability will fall.

So, a die casting method has been awaited with which the occurrence of nesting is suppressed by a semi-solid metal being used as the casting material and there is no breaking of sand cores and the yield of the cast moldings can be increased.

DISCLOSURE OF THE INVENTION

The present invention, in a first aspect, provides a semi-solid metal solid phase percentage management method, made up of: a step of preparing a map expressing a correlation between solid phase percentage and viscosity of a slurry-form semi-solid metal for a given metal composition; a step of setting a target viscosity corresponding to a target solid phase percentage using this map; a viscosity measuring step of measuring the viscosity of a semi-solid metal in a vessel while cooling it; and a step of carrying out cooling until this viscosity reaches the target viscosity, wherein by these steps being carried out in from the preparation of the map expressing the correlation between solid phase percentage and viscosity of the semi-solid metal to the end of cooling of the semi-solid metal, the solid phase percentage of the semi-solid metal is made to match the target solid phase percentage.

In the process of cooling the semi-solid metal, its viscosity is detected, and the solid phase percentage of the semi-solid metal is managed on the basis of this viscosity. Because the viscosity is detected, the influences of cooling rate changes and time can be eliminated, and the semi-solid metal solid phase percentage management accuracy can be raised much further than with related art management based on time.

In a second aspect, the invention provides an apparatus for measuring the viscosity of a semi-solid metal, made up of: stirring means for stirring a slurry-form semi-solid metal in a vessel; a probe in the form of a cantilever beam having a lower part to be inserted in the semi-solid metal; probe moving means for moving this probe in a horizontal direction; a load cell for measuring a force that this probe receives from the semi-solid metal; and converting means for converting from a force detected with this load cell to a viscosity of the semi-solid metal.

A semi-solid metal viscosity measuring apparatus is made up of stirring means, a probe in the form of a cantilever beam, probe moving means, a load cell, and converting means. These are all easily obtained, simple means or parts, and low cost and compactness of the viscosity measuring apparatus can be achieved easily.

In a third aspect, the invention provides, in a metal molding production line which is a metal molding production line made up of: a vessel capable of receiving a predetermined amount of melt; a semi-solid metal production apparatus for making a slurry-form semi-solid metal by cooling and stirring a melt in the vessel; a molding machine for molding a metal molded product with the semi-solid metal as a starting material; a carrying apparatus for carrying the vessel from the semi-solid metal production apparatus to the molding machine and feeding the semi-solid metal in the vessel into the molding machine; and a vessel restoring apparatus for carrying out a predetermined restoring treatment on the vessel emptied by the feeding of the semi-solid metal into the molding machine, the vessel restoring apparatus having air blowing means for removing adhered metal inside the vessel while cooling the vessel by blowing air into the vessel and coating means for applying a releasing agent to the inside of the vessel, a metal molded product production line wherein the vessel restoring apparatus further has scraping means for scraping off semi-solid metal adhered to the inside of the vessel before the treatment with the air blowing means.

With this construction, even if semi-solid metal remains inside the vessel in relatively large lumps after the semi-solid metal is fed into the molding machine, these lumps are scraped off by the scraping means. Consequently, when treatment with air blowing means is carried out, no semi-solid metal remains still in large lumps inside the vessel, and the adhered metal in the vessel is removed efficiently by the air blowing means. Consequently, the frequency with which adhered metal remains in the vessel after the restoring treatment, i.e. the frequency of carrying out restoring work on vessels outside the line, becomes as low as possible. As a result, not so many vessels have to be prepared, and a reduction in initial cost can be achieved. And, because the vessel becoming difficult to cool down due to an influence of large lumps of semi-solid metal in the vessel is also prevented, the vessel is cooled efficiently by the air blowing means. Accordingly, the cooling time of the vessel is shortened and productivity also rises.

As the scraping means, it is also conceivable to use a robot fitted with a scraper; however, this raises cost. Here, if the carrying apparatus is provided as a multiple joint robot as in related art, even if the scraping means is constructed as a scraper installed in a fixed position, semi-solid metal adhered to the inside of the vessel can be removed by the vessel emptied by the feeding of the semi-solid metal into the molding machine being moved relative to the scraper while still gripped by the carrying robot. In this way it is possible to simplify the construction of the scraping means and achieve cost reductions.

When pouring semi-solid metal into the molding machine and when scraping off semi-solid metal in the vessel with scraping means, semi-solid metal tends to adhere to the mouth of the vessel, and if this is left as it is, semi-solid metal sets at the mouth of the vessel, and at the time of feeding of the semi-solid metal into the molding machine there is a possibility of semi-solid metal dropping from the mouth of the vessel and entering the molding machine and of molding defects arising. In this case, if the scraper is made one having a flat-plate like first spatula part capable of contacting the inner face of the vessel and a substantially L-shaped second spatula part capable of contacting the mouth of the vessel and the vessel is moved relatively with the first spatula brought into contact with the inner face of the vessel to scrape off semi-solid metal adhered to the inner face of the vessel and then the vessel is moved relatively with the mouth of the vessel brought into contact with the second spatula to scrape off semi-solid metal adhered to the mouth of the vessel, it is possible to prevent semi-solid metal from solidifying while still adhered to the mouth of the vessel, which is advantageous.

When the vessel restoring apparatus has brushing means for cleaning the inside of the vessel with a brush after the treatment with the air blowing means, although the probability of it in this invention is low, if adhered metal above a certain size remains inside the vessel, there is a risk of breakage of the brush arising. Therefore, it is preferable to provide detecting means for, when adhered metal above a predetermined size remains inside the vessel treated with the air blowing means, detecting this, and when the remaining of adhered metal of above the predetermined size is not detected by the detecting means, to carry out treatment with the brushing means, to prevent breakage of the brush.

In a fourth aspect, the invention provides, in a restoring apparatus which is a restoring apparatus of stirring means for carrying out after the production of a semi-solid metal a predetermined restoring treatment on stirring means of a semi-solid metal production apparatus for making a slurry-form semi-solid metal by cooling and stirring a melt with stirring means having a cooling metal and a probe for viscosity measurement to be immersed in a melt contained in a vessel and is made up of cooling means for cooling the cooling metal and the probe of the stirring means by dipping them in water and coating means for applying a releasing agent to the cooling metal and the probe, a stirring means restoring apparatus of a semi-solid metal production apparatus characterized in that the restoring apparatus further comprises scraping means for scraping off semi-solid metal adhered to the probe before the treatment with the cooling means, and the cooling means has a space compartment which water does not enter for receiving the probe, and has a first dipping part for dipping the cooling metal only and a second dipping part for dipping at least the probe.

In a fifth aspect, the invention provides, in a stirring means restoring method which is a restoring method of stirring means carried out after the production of a semi-solid metal on stirring means of a semi-solid metal production apparatus for making a slurry-form semi-solid metal by cooling and stirring a melt with stirring means having a cooling metal and a probe for viscosity measurement to be immersed in a melt contained in a vessel and is made up of a cooling step of cooling the cooling metal and the probe of the stirring means by dipping them in water and a coating step of applying a releasing agent to the cooling metal and the probe after the cooling step, a stirring means restoring method of a semi-solid metal production apparatus characterized in that it includes a scraping step of scraping off semi-solid metal adhered to the probe before the cooling step, and the cooling step is made up of a first dipping step of dipping only the cooling metal in water and a second dipping step of dipping at least the probe in water, and the treatment time of the second dipping step is set shorter than the treatment time of the first dipping step.

By the above construction, most of the semi-solid metal adhered to the probe immediately after the making of the semi-solid metal is scraped off by the scraping means (scraping step) However, it is difficult to remove semi-solid metal adhered to the probe completely with scraping means, and sometimes semi-solid metal remains on the probe in the form of a thin film.

Here, when the probe is dipped in water in the second dipping part (second dipping step), semi-solid metal in the form of a thin film remaining on the probe is flaked off easily even though the energy of the flash-boiling of the water is not that strong. Consequently, the adhered metal on the probe is removed efficiently. And, because in the first dipping part (first dipping step) only the cooling metal is cooled, even if the treatment time in the first dipping step is set to the time needed for the cooling metal to be cooled to a predetermined temperature, the probe is not cooled excessively. And by the treatment time in the second dipping step being set short so that the probe is cooled to a predetermined temperature in the second dipping part (second dipping step), the probe can be cooled optimally, and the problem of releasing agent applied to the probe in the coating means (coating step) not drying readily does not arise. Consequently, restoring treatment of stirring means having a cooling metal and a probe can be carried out certainly and with good efficiency.

The present inventors, in investigating the causes of the above-mentioned variation in melt stirring time, noticed that a time difference arises in the brushing treatment in S9 (step 9) of FIG. 37, and because of that the amount of heat dissipated to the atmosphere increases with the time elapsed and the temperature of the vessel becomes unstable. That is, the forms of residuum adhered to the empty vessel are various, and those which can be cleaned easily in one attempt and those which need several cleanings appear.

So, they arrived at the idea that it would be beneficial to carry out cooling after cleaning and coating are carried out, and make the temperature of the vessel constant by making the temperature after cooling constant.

Also the present inventors noticed that in S1 (step 1) of FIG. 37 the temperature of melt supplied from the melt holding furnace varies.

There is variation in the temperature of the melt supplied from an aluminum melting furnace, and this variation affects the melt holding furnace and the temperature of melt from the melt holding furnace also varies.

If the temperature of the vessel is fixed and there is variation in the temperature of the melt, then this will appear as variation in the stirring time.

To make the temperature of the melt supplied from the melt holding furnace constant, although it is conceivable to provide the melt holding furnace with a high-performance temperature control mechanism, technologically and cost-wise realization of this is difficult.

That is, technology with which it is possible to absorb fluctuations in melt supplied from the melt holding furnace is sought.

In this connection, the idea occurred to the inventors of shifting the affect of the temperature of the melt holding furnace to the temperature of the vessel, as in, if the temperature of the melt holding furnace is high, extending the vessel cooling time, and if the that temperature is low, shortening the cooling time.

And when they determined the cooling time of the melt temperature taking into account both the temperature of the vessel and the temperature of the melt holding furnace, they succeeded in greatly reducing the amplitude of variation of the stirring time. Summarizing the invention from the foregoing knowledge, it becomes as follows.

In a sixth aspect, the invention provides, in a semi-solid metal injection-molding method wherein repeatedly a vessel emptied by having a slurry-form semi-solid metal poured from it into a molding machine is cooled for a predetermined time in preparation for a next pouring and then semi-solid metal is supplied from a melt holding furnace to this cooled vessel, a semi-solid metal injection-molding method characterized in that the predetermined time of when the empty vessel is cooled in preparation for the next pouring is determined on the basis of the temperature of the melt holding furnace and the temperature of the empty vessel.

When the temperature of the melt holding furnace is high, the required time is extended, and when that temperature is low the required time is shortened. And in combination with this, when the temperature of the empty vessel is high the required time is extended, and when that temperature is low the required time is shortened. Because the empty vessel is cooled for a required time determined on the basis of the temperature of the melt holding furnace and the temperature of the empty vessel like this, variation in the stirring time can be suppressed, and it is possible to greatly raise productivity in injection-molding a semi-solid metal.

In a seventh aspect, the invention provides, in a die casting method for obtaining a cast molding by injecting a slurry-form semi-solid metal with an injecting piston through a gate and forcing the semi-solid metal through a runner and a weir into a cavity having a sand core provided inside it, a cast molding die casting method characterized in that before the leading part of the semi-solid metal is forced into the cavity the injecting piston is slowed down and the flow speed of the semi-solid metal is lowered.

By slowing down the semi-solid metal like this before forcing it into the cavity, it is possible to prevent the semi-solid metal from breaking sand cores inside the cavity. And, by moving the semi-solid metal at a high speed in a short time to just before it enters the cavity, it is possible to prevent a fall in runability caused by hardening or temperature reduction;

In this case, it is desirable for the injecting piston to be slowed down at a position 90 to 97% of the way from the injection start position of the injecting piston to the position of the injecting piston when the semi-solid metal first starts to enter the cavity. By the injecting piston being slowed down like this at a point in time somewhat earlier than the point in time at which the semi-solid metal is first forced into the cavity, when the semi-solid metal enters the cavity it is slowed down to a suitable speed such that it will not break the sand cores.

This die casting method, by using a semi-solid metal, makes it possible to obtain a high-quality cast molding in which the occurrence of nesting has been suppressed, and it is suitably applied to cast moldings of parts which are of a complex shape and moreover are important strengthwise, such as a cylinder block of the closed deck type or the semi-closed deck type. And, by the semi-solid metal being slowed down, even if a sand core corresponds to a thinly shaped part such as a water jacket, the cavity is filled optimally without the sand core being broken.

With this die casting method, it is possible to suppress the occurrence of nesting by using a semi-solid metal as the casting material, and to achieve increases in cast molding yield because there is no breaking of sand cores. And, because in the gate and runner parts the semi-solid metal moves at a high speed for a short time, it is possible to prevent a fall in runability caused by hardening or the temperature falling.

BEST MODES FOR CARRYING OUT THE INVENTION

Figure 1:
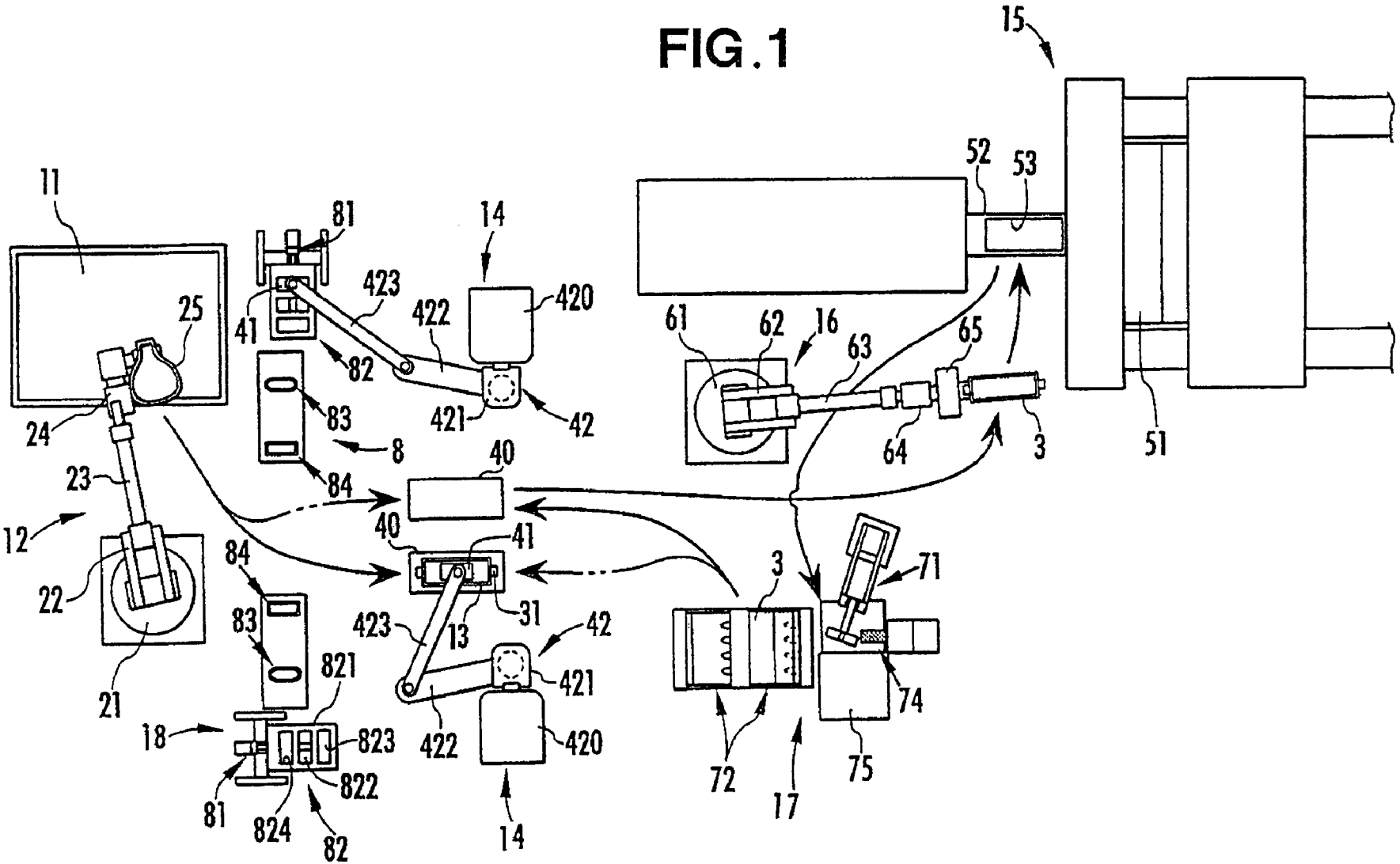
FIG. 1 is an overall plan view of a production line of an embodiment of the invention.

FIG. 1 shows a production line 10 of a molded metal product. This production line 10 has a melt holding furnace 11 for holding a melt consisting of a molten metal such as aluminum alloy; a melt scooping robot 12 for scooping out a predetermined amount of melt from inside the melt holding furnace 11; a vessel 13, rectangular in plan view, for pouring melt scooped out by the melt scooping robot 12; a semi-solid metal producing apparatus 14 for producing semi-solid metal by stirring and cooling the melt in the vessel 13; a molding machine 15 for molding a metal molded product with the semi-solid metal as a starting material; and a carrying robot 16 serving as a carrying apparatus for carrying the vessel 13 from the semi-solid metal producing apparatus 14 to the molding machine 15 and feeding the semi-solid metal in the vessel 13 into the molding machine 15. Also, the production line 10 is provided with a vessel restoring apparatus 17 for carrying out a restoration treatment on the vessel 13 and a stirring head restoring apparatus 18 for a stirring head 41 serving as stirring means, which will be discussed later, of the semi-solid metal producing apparatus 14.

The melt scooping robot 12 is provided as a 6-axis multiple joint robot having a revolving robot body 21, a first robot arm 22 which is swingable with respect to the revolving robot body 21, a second robot arm 23 which is swingable with respect to the first robot arm 22, and a wrist 24 of 3-axis construction at the end of the second robot arm 23. A ladle 25 is attached to the end of the wrist 24, and melt inside the melt holding furnace 11 can be scooped out with the ladle 25.

A pair of the semi-solid metal producing apparatuses 14 are provided in parallel. Each semi-solid metal producing apparatus 14 is made up of a table 40 for a vessel 13, a stirring head 41 for stirring melt inside the vessel 13, and a stirring robot 42 for moving the stirring head 41. This stirring robot 42 has a robot body 421 supported raise/lowerably on a support post 420, a first robot arm 422 which is swingable in the horizontal direction with respect to the robot body 421, and a second robot arm 423 which is swingable in the horizontal direction with respect to the first robot arm 422, and the stirring head 41 is suspended rotatably about a vertical axis from the end of the second robot arm 423.

Figure 2:
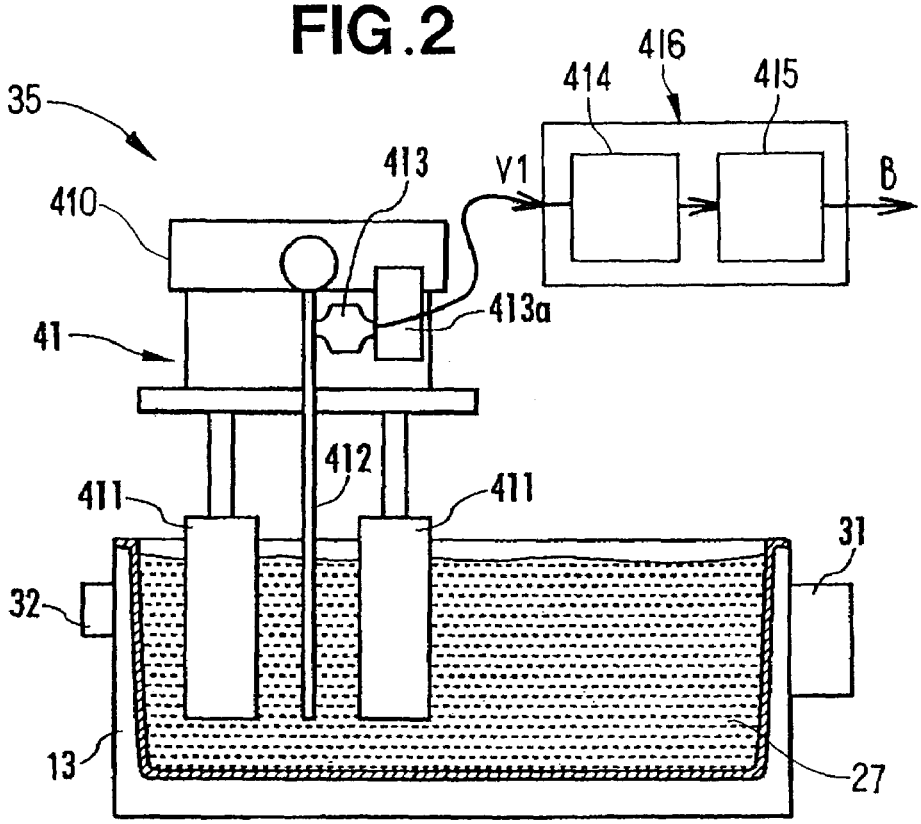
FIG. 2 is a schematic side view of a viscosity measuring apparatus.

As shown in FIG. 2, the stirring head 41 has cooling metal moving means 410, which will be discussed in detail later; a pair of square-prism like cooling metals 411, 411, hangingly mounted on the cooling metal moving means 410; and a thin-plate like viscosity measuring probe 412, hangingly mounted inclinably in a position between the two cooling metals 411, 411. A load cell 413 mounted on a bracket 413*a* fixed to the cooling metal moving means 410 is connected to the probe 412.

In FIG. 1, in production of the semi-solid metal, first, melt inside the ladle 25 is poured into a vessel 13 on a table 40 by operation of the melt scooping robot 12, and then, by operation of the stirring robot 42, as shown in FIG. 2, the stirring head 41 is moved to a position directly above the vessel 13 and lowered, and the cooling metals 411, 411 and the probe 412 are immersed in the melt in the vessel 13. In this state, the stirring head 41 is moved horizontally in a rectangle corresponding to the shape of the vessel 13, as shown with arrows in FIG. 3. In this way, the melt in the vessel 13 is cooled and stirred by the cooling metals 411, 411, and a semi-solid metal in the form of a slurry is made. And, due to the horizontal motion of the stirring head 41 (see FIG. 2), the probe 412 receives a resistance force corresponding to the viscosity of the semi-solid metal 27, this resistance force is detected by the load cell 413 (see FIG. 2), and the viscosity is measured on the basis of a detection signal of the load cell 413. And, stirring is carried out until the measured value of the viscosity reaches a predetermined target value, whereby a semi-solid metal 27 of a predetermined solid phase percentage is made.

Because it takes time for the semi-solid metal 27 to be made, semi-solid metal 27 (see FIG. 2) production work is carried out alternately with the pair of semi-solid metal producing apparatuses 14, 14, as shown in FIG. 1, so that the cycle time is prevented from being prolonged by the time taken to produce the semi-solid metal 27. And, the vessel 13 is a casting, and, as shown in FIG. 3, a handle part 31 is provided projecting from one length direction end thereof, and a projecting part 32 for engaging with a receiving frame 721 (see FIG. 5) of air blowing means 72 (see FIG. 1), which will be further discussed later, of the vessel restoring apparatus 17 (see FIG. 1) is provided projecting from the other end.

The reference number 35 shown in FIG. 2 denotes a viscosity measuring apparatus. The viscosity measuring apparatus 35 is a construction characterized in that it is made up of the cooling metals 411, 411 serving as stirring means; the probe 412, which has the form of a cantilever beam; the cooling metal moving means 410 for moving this probe 412 in horizontal directions; the load cell 413 for measuring the force received by the probe 412; the bracket 413*a*, to which this load cell 413 is fixed; and the force viscosity converting means 416, which has force converting means 414 for converting a physical quantity from the load cell 413 into a viscosity and viscosity converting means 415.

In the semi-solid metal 27 in the vessel 13, the viscosity measuring apparatus 35 is an apparatus for recognizing with the load cell 413 for example as a skew voltage V1 the force received by the cooling metals 411, 411 and the probe 412 from the semi-solid metal 27 as a result of the cooling metals 411, 411 moving and the probe 412 being moved horizontally by the cooling metal moving means 410, and then obtaining a viscosity B by means of the force-viscosity converting means 416.

Figure 3:
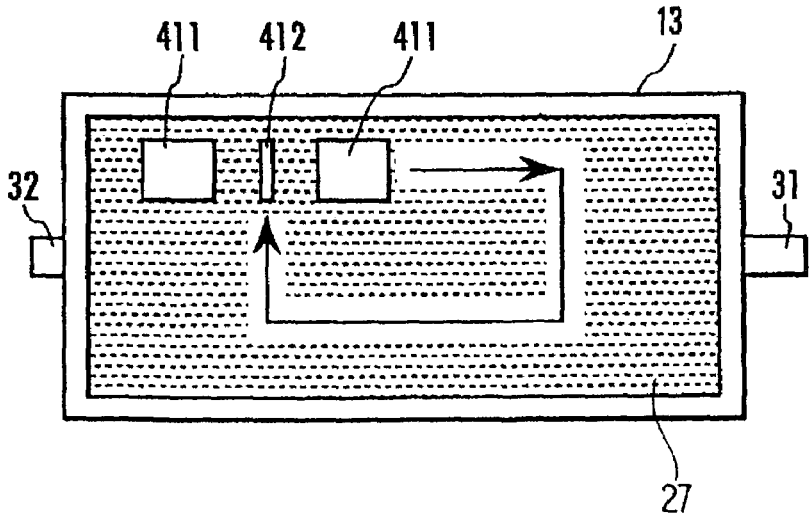
FIG. 3 is a plan view showing the locus of movement of a stirring head in the making of a semi-solid metal.

In FIG. 3, because the cooling metals 411, 411 and the probe 412 are integral, the probe 412 can move with the rectangular movement of the cooling metals 411, 411. As a result, even if the probe 412 is being moved in the horizontal direction by the cooling metal moving means 410 (see FIG.

2), the forces that the cooling metals 411, 411 and the probe 412 receive from the semi-solid metal 27 can be transmitted to the load cell 413 as substantially the same.

Figure 4:
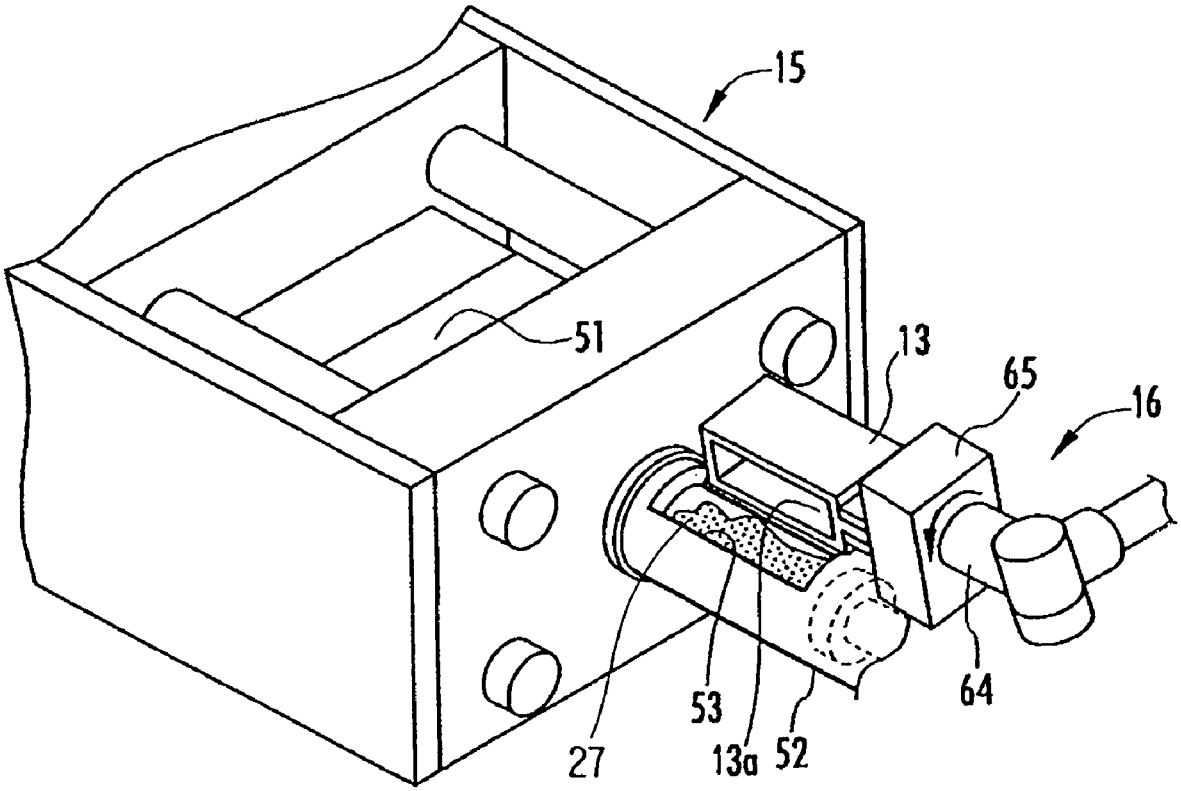
FIG. 4 is a perspective view showing a semi-solid metal being poured into a molding machine.

As shown in FIG. 1, the molding machine 15 has a mold 51 and an injection sleeve 52 connecting with a cavity inside the mold 51. In an upper face of the injection sleeve 52, as shown in FIG. 4, a starting material feed opening 53 is provided, and semi-solid metal 27 fed into the starting material feed opening 53 is pushed into the cavity and a metal molded product is thereby molded.

As shown in FIG. 1, the carrying robot 16, like the melt scooping robot 12, is provided as a 6-axis multiple joint robot having a revolving robot body 61, a first robot arm 62 which is swingable with respect to the robot body 61, a second robot arm 63 which is swingable with respect to the first robot arm 62, and a wrist 64 of 3-axis construction at the end of the second robot arm 63. A hand 65 for gripping a vessel 13 is attached to the end of the wrist 64, and the hand 65 grips the handle part 31 of the vessel 13. Of the pair of semi-solid metal producing apparatuses 14, 14, the vessel 13 on the table 40 of the semi-solid metal producing apparatus 14 in which production of semi-solid metal has finished is gripped by the carrying robot 16, by the operation of the carrying robot 16 the vessel 13 is carried to the starting material feed opening 53 of the injection sleeve 52 of the molding machine 15 and the vessel 13 is tipped, whereby the semi-solid metal in the vessel 13 is poured into the starting material feed opening 53. At the time of feeding, the vessel 13 is vibrated with a vibrator (not shown) disposed in the vicinity of the hand 65 so that as far as possible no semi-solid metal remains in the vessel 13. Here, the hand 65 is constructed to allow movement of the vessel 13 in the vibration direction, and normally the vessel 13 is prevented from moving in the vibration direction by a lock mechanism, but at the time of feeding of the semi-solid metal into the starting material feed opening 53 the lock is released and the vessel 13 is vibrated by the vibrator.

Figure 5:
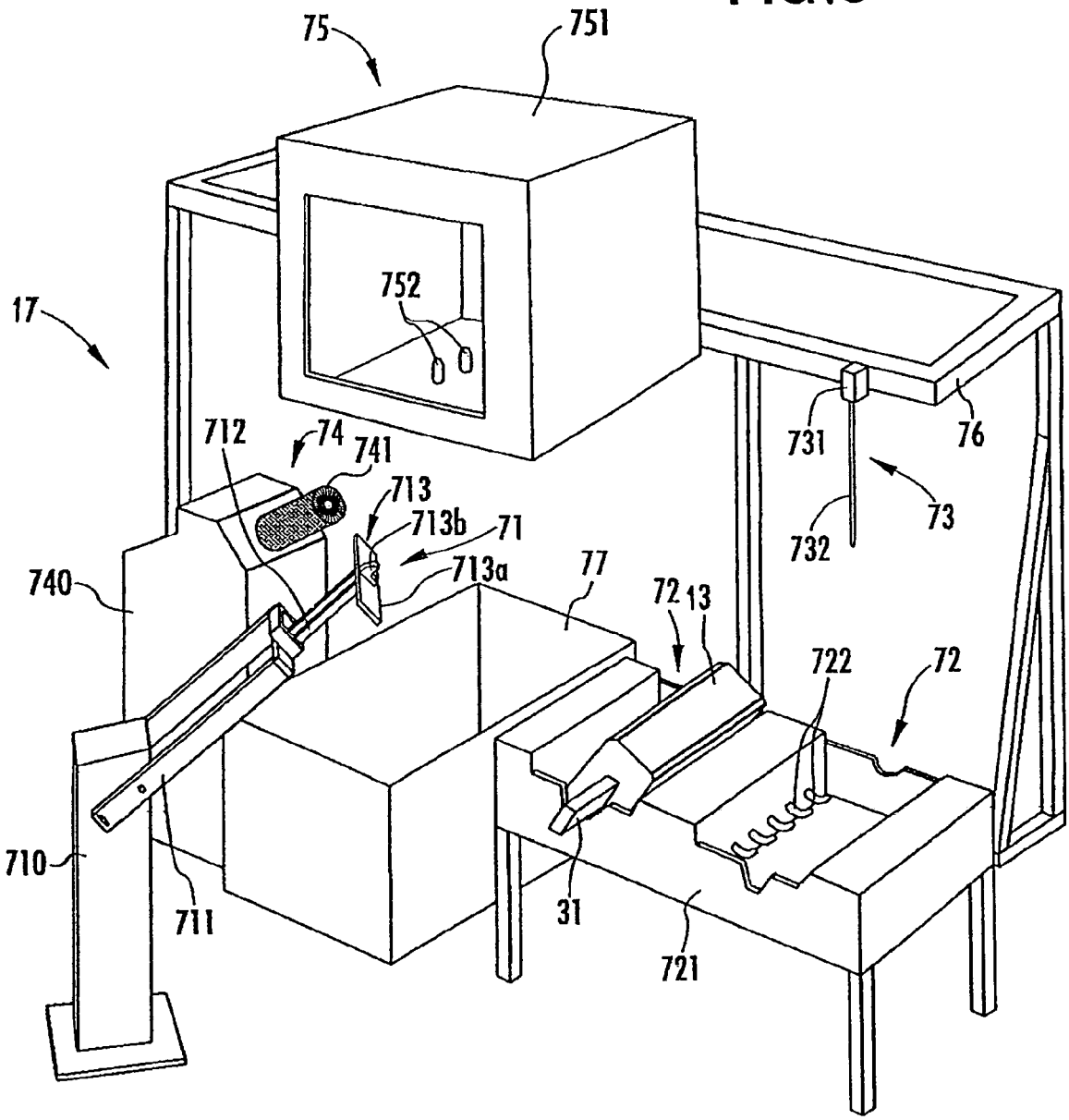
FIG. 5 is a perspective view showing a vessel restoring apparatus.

The vessel 13 having been emptied by the pouring of the semi-solid metal into the starting material feed opening 53 is carried to the vessel restoring apparatus 17 and undergoes a predetermined restoring treatment. The vessel restoring apparatus 17, as shown in FIG. 5, has scraping means 71 for scraping off semi-solid metal adhered to the inside of the vessel 13; air blowing means 72 for removing metal adhered to the inside of the vessel 13 while cooling the vessel 13 by blowing air at the inside of the vessel 13; detecting means 73 for, when adhered metal above a predetermined size remains on the inside of the vessel 13, detecting this; brushing means 74 for cleaning the inside of the vessel 13; and coating means 75 for applying a releasing agent to the inside of the vessel 13.

Figure 6:
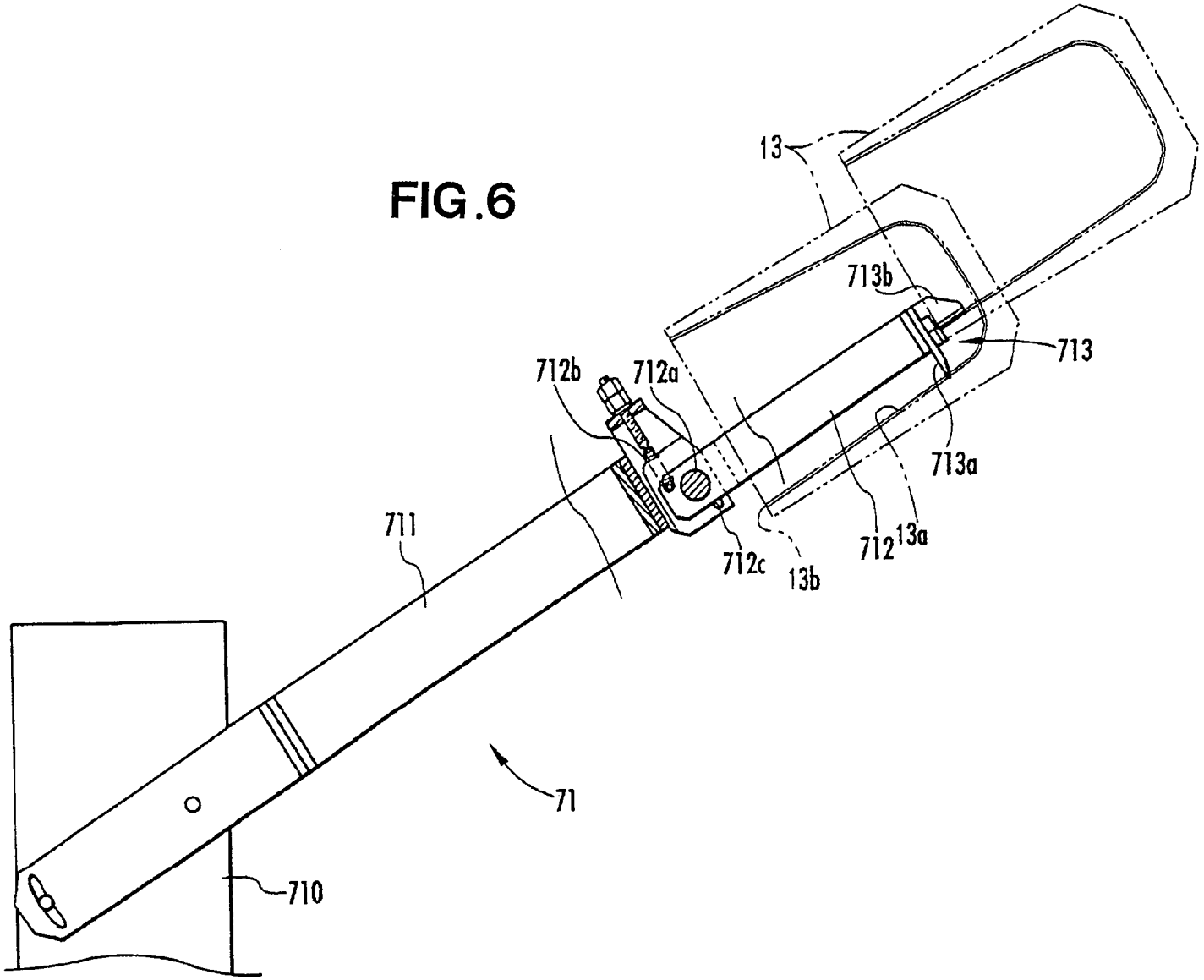
FIG. 6 is a side view of scraping means of the vessel restoring apparatus.
Figure 7:
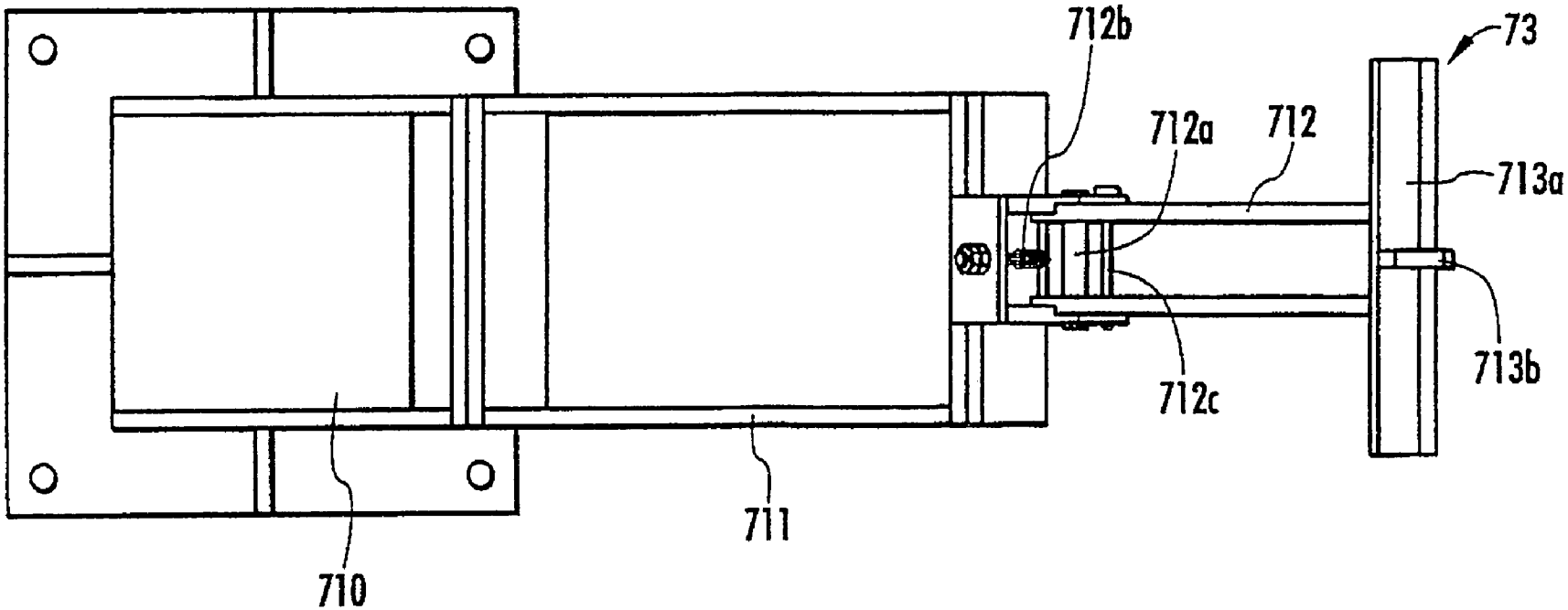
FIG. 7 is a plan view of the scraping means.

Referring also to FIG. 6 and FIG. 7, the scraping means 71 has a scraper 713 mounted by way of an arm 712 to the end of a bracket 711 extending diagonally upward from a support post 710. The scraper 713 has a laterally long, flat-plate like first spatula part 713*a* and an approximately L-shaped second spatula part 713*b* fixed so as to project at a right angle from the outer face of the middle of the first spatula part 713*a*. And, the arm 712 has its base end pivotally attached to the bracket 711 by a support shaft 712*a* so that it is swingable in the up-down direction. The arm 712 is urged downward by a spring 712*b*, and normally the arm 712 is held in a predetermined inclined attitude by a stopper 712*c* fixed to the bracket 711.

Here, when the semi-solid metal in the vessel 13 is poured into the starting material feed opening 53 (see FIG. 4), semi-solid metal sometimes remains adhered in relatively large lumps to the inner face (hereinafter written pouring wall face) 13*a* of the side wall of the vessel 13 that was on the lower side at the time of pouring. So, the vessel 13 having been emptied by the pouring of the semi-solid metal into the starting material feed opening 53 is carried to where the scraping means 71 is disposed while still gripped in the carrying robot 16 (see FIG. 1), while pointed diagonally downward the vessel 13 is moved so that the scraper 713 is inserted into the vessel 13, and the vessel 13 is positioned so that the first spatula part 713*a* makes contact with a part of the pouring wall face 13*a* of the vessel 13 near the bottom of the vessel.

At this time the arm 712 is pushed up from the stopper 712*c*, and under the urging force of the spring 712*b* the first spatula part 713*a* is pushed against the pouring wall face 13*a* of the vessel 13. After that, the vessel 13 is moved diagonally upward. In this way, semi-solid metal adhered to the pouring wall face 13*a* of the vessel 13 is scraped off by the first spatula part 713*a* and discarded through the open end of the vessel 13. In this case, semi-solid metal remains at the mouth 13*b* of the pouring wall face 13*a* of the vessel 13. So, next, the vessel 13 is positioned so that the second spatula part 713*b* makes contact with the mouth 13*b* of the pouring wall face 13*a* of the vessel 13, and in this state the vessel 13 is moved in the normal direction to the second spatula part 713*b* (the direction orthogonal to the plane of the paper in FIG. 6).

In this way, semi-solid metal remaining adhered to the mouth 13*b* of the pouring wall face 13*a* of the vessel 13 is scraped off.

When the semi-solid metal adhered to the inside of the vessel 13 has been scraped off by the scraping means 71 as described above, the vessel 13 is carried by the carrying robot 16 (see FIG. 1) to where the air blowing means 72 is disposed. As shown in FIG. 5, the air blowing means 72 has a receiving frame 721 for supporting the vessel 13 in a downwardly faced state, and multiple air nozzles 722 for blowing air at the inside of the vessel 13 supported on the receiving frame 721. By the operation of the carrying robot 16 (see FIG. 1) the vessel 13 is placed on the receiving frame 721 in a downward-facing attitude, and in this state air is blown from the air nozzles 722. In this way, the vessel 13 is cooled by the blowing of air, and semi-solid metal remaining adhered to the inner face of the vessel 13 is solidified and blown off. In this case, when semi-solid metal remains in relatively large lumps, it is difficult to solidified and blow these off; however, because large lumps of semi-solid metal remaining in the vessel 13 have been removed in advance by the scraping means 71, adhered metal inside the vessel 13 is efficiently removed by the air blowing means 72.

Here, the cooling treatment time of the air blowing means 72 (the time for which air is blown from the air nozzles 722) should be set to match the time needed for the vessel 13 to be cooled to a predetermined temperature. So, after the completion of restoring treatment by the vessel restoring apparatus 17, by temperature measuring means not shown in the figures the temperature of the vessel 13 is measured, and this measured temperature is fed back to regulate the cooling treatment time of the air blowing means 72. When semi-solid metal is adhered to the vessel 13 in relatively large lumps, the vessel 13 cools less easily, and due to deficient cooling the cooling treatment time after that is set excessively long. However, in this embodiment, because large lumps of semi-solid metal are removed in advance by the scraping means 71, this problem does not arise. Nonetheless, a certain amount of time is necessary for the cooling of the vessel 13, and to prevent the cycle time from being prolonged by this cooling time, a pair of air blowing means 72 are provided in parallel, and cooling treatment of vessels 13 is carried out alternately with the two air blowing means 72, 72. After the vessel 13 used this time is placed in one of the air blowing means 72, the treated vessel 13 placed on the other air blowing means 72 is gripped by the carrying robot 16 (see FIG. 1), and this vessel 13 is carried to where the detecting means 73 is disposed.

The detecting means 73 is provided in the form of a limit switch 731 attached to a frame 76 standing beside the air blowing means 72. A contact 732 extending downward is attached to the limit switch 731. With the vessel 13 lifted by the carrying robot 16 in an upwardly-facing attitude so that the contact 732 is inserted into the vessel 13 and the vessel 13 positioned so that there is a predetermined gap between the inner face of the vessel 13 and the contact 732, the vessel 13 is moved in parallel with that inner face. In this way, when adhered metal of a size greater than the gap remains on the inner face of the vessel 13, this adhered metal touches the contact 732 and the limit switch 731 turns on. When the limit switch 731 has turned on, the vessel 13 is removed to outside the line, and restoring treatment of the vessel 13 is carried out outside the line. When treatment with the air blowing means 72 is carried out after treatment with the scraping means 71 is carried out as described above, the probability of adhered metal of a size greater than the gap remaining on the inner face of the vessel 13 becomes extremely low, and consequently, the frequency with which restoring treatment of a vessel 13 outside the line becomes necessary is also extremely low.

When the limit switch 731 did not turn on, that is, when no adhered metal larger than a predetermined size remained in the vessel 13, the carrying robot 16 carries the vessel 13 to where the brushing means 74 is disposed.

The brushing means 74 has a brush 741 extending diagonally upward provided on an upper part of a support post 740, and the brush 741 is rotated by a motor not shown in the figures. The carrying robot 16 moves the vessel 13 in a diagonally downward-facing state so that the brush 741 is inserted into the vessel 13 and positions the vessel 13 so that the brush 741 makes contact with the inner face of the vessel 13, and then moves the vessel 13 relative to the brush 741. In this way, small metal fragments and old coating film remaining inside the vessel 13 are removed, and the surface roughness of the inner face of the vessel 13 is restored well. In this case, when large adhered metal remains inside the vessel 13, there is a possibility of this causing breakage of the brush 741, but because the treatment with the brushing means 74 is carried out when the remaining of adhered metal above a predetermined size in the vessel 13 was not detected by the detecting means 73, breakage of the brush 741 can be prevented. The scraping means 71 and the brushing means 74 are disposed adjacently, and a receiving box 77 for receiving adhered matter removed from the vessel 13 by these means 71, 74 is provided.

When the treatment with the brushing means 74 is completed, the carrying robot 16 carries the vessel 13 to where the coating means 75 is disposed. The coating means 75 has a case 751 mounted on the frame 76 and releasing agent coating nozzles 752 provided inside the case 751. The carrying robot 16 inserts the vessel 13 into the case 751, and the coating nozzles 752 apply releasing agent to the inner face of the vessel 13.

When treatment with the coating means 75 is completed like this, as shown in FIG. 1, the carrying robot 16 places the vessel 13 on the table 40 of the one of the semi-solid metal producing apparatus 14 from which a vessel 13 has previously been removed. Then, the carrying robot 16 grips the vessel 13 placed on the table 40 of the other semi-solid metal producing apparatus 14, in which semi-solid metal has been made, and carries this vessel 13 to the molding machine 15. The actions described above are then repeated to manufacture the metal molded product continuously.

Figure 8:
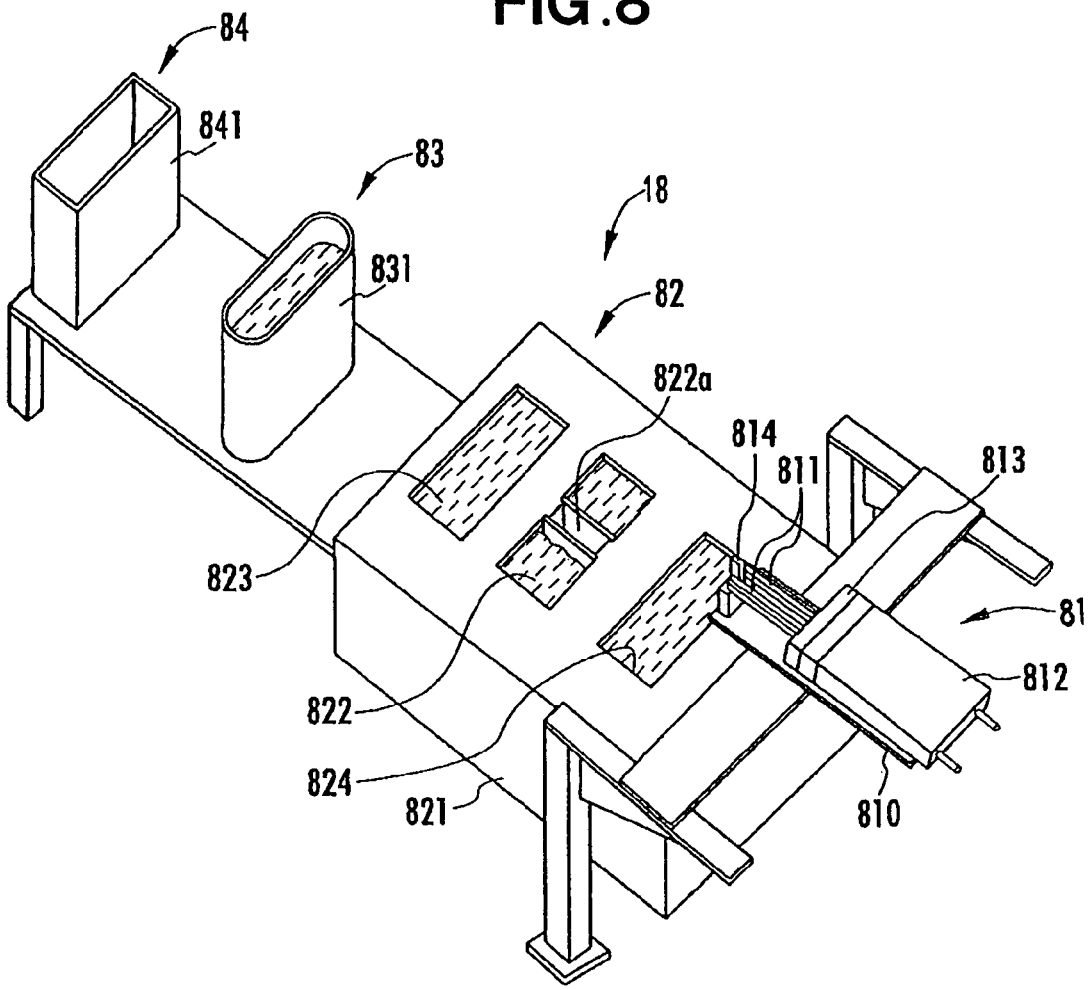
FIG. 8 is a perspective view showing a stirring head restoring apparatus.

And, when the making of semi-solid metal in the semi-solid metal producing apparatuses 14 finishes, restoring treatment on the stirring head 41 is carried out by the stirring head restoring apparatus 18. The stirring head restoring apparatus 18, as shown in FIG. 8, has scraping means 81 for scraping off semi-solid metal adhered to the probe 412 (see FIG. 2) of the stirring head 41 (see FIG. 2), cooling means 82 for cooling the cooling metals 411, 411 (see FIG. 2) and the probe 412 by dipping them in water, coating means 83 for applying releasing agent to the cooling metals 411, 411 and the probe 412, and temperature holding means 84 for holding the temperature of the cooling metals 411, 411 and the probe 412.

Figure 9:
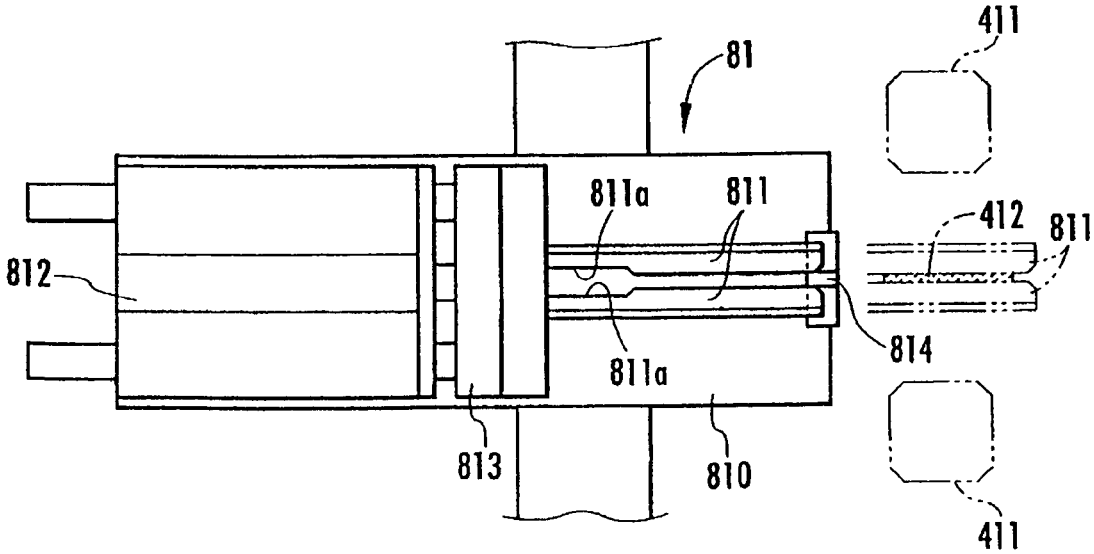
FIG. 9 is a plan view of scraping means of the stirring head restoring apparatus.

The scraping means 81, as shown in FIG. 9, has a pair of scrapers 811, 811 for sandwiching the probe 412. The two scrapers 811, 811 are supported on a moving member 813 advanced and retracted by a cylinder 812 on a base 810, open/closeably and urged to their closed sides by springs not shown in the figures. A guide 814 provided between the two scrapers 811, 811 for opening the two scrapers 811, 811 to more than the plate thickness of the probe 412 is mounted vertically on an end part of the base 810. After the making of the semi-solid metal is completed, the stirring robot 42 moves the stirring head 41 to position the probe 412 in front of the base 810, and lowers the stirring head 41 so that the upper end of the probe 412 comes to the same height as the two scrapers 811, 811. In this state, the stirring head 41 is positioned above an end of a water tank 821 (see FIG. 8), which will be further discussed later. As shown in FIG. 8, an opening 824 positioned directly below the stirring head 41 is formed in a top cover of the water tank 821.

Next, as shown in FIG. 9, the two scrapers 811, 811 are advanced to in front of the base 810 by the cylinder 812. Here, recessed parts 811*a* are formed in the inside faces of the tail ends of the scrapers 811, 811, and when these recessed parts 811*a* have been advanced to the position where they abut with the guide 814, the opening of the two scrapers 811, 811 by the guide 814 is canceled and the probe 412 is sandwiched between the scrapers 811, 811 elastically. Then, the stirring head 41 is lifted. In this way, the two scrapers 811, 811 are moved downward relative to the probe 412, and semi-solid metal that had been adhered to the probe 412 is scraped off. The semi-solid metal scraped from the probe 412 falls through the opening 824 shown in FIG. 8 and into the water tank 821.

Figure 10:
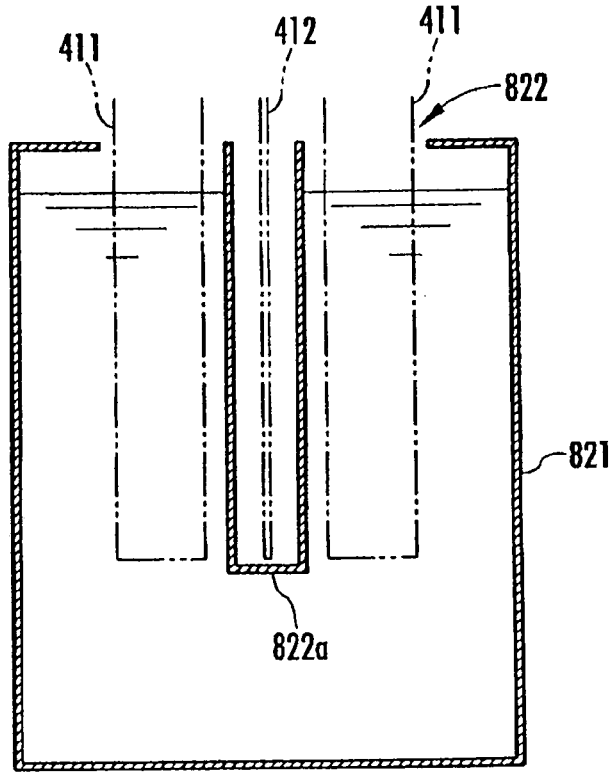
FIG. 10 is a sectional view of a first dipping part provided in cooling means of the stirring head restoring apparatus.

When semi-solid metal adhered to the probe 412 has been scraped off with the scraping means 81 like this, the stirring head 41 is carried to where the cooling means 82 is disposed by the operation of the stirring robot 42. The cooling means 82 has the water tank 821, which is filled with water at a temperature of about 70° C. To increase restoring treatment efficiency, the water tank 821 is disposed adjacent to the scraping means 81. A first dipping part 822 and a second dipping part 823 are provided in the water tank 821. In the first dipping part 822, as shown in FIG. 10, a spacing compartment 822*a*, which no water enters, for receiving the probe 412, is provided. Consequently, when the stirring head 41 is moved to a position directly above the first dipping part 822 and lowered, the probe 412 is inserted into the spacing compartment 822*a* and only the cooling metals 411 are immersed in water. The temperature of the cooling metals 411 immediately after making the semi-solid metal is a high temperature close to 600° C., and when the cooling metals 411 are dipped in the water the water flash-boils and the energy of the flash-boiling causes adhered metal to detach and drop from the cooling metals 411. The cooling metals 411 are immersed in the water for about 60 seconds and thereby cooled to a predetermined temperature (for example 100 to 120° C.).

When the cooling of the cooling metals 411 in the first dipping part 822 finishes, next, as shown in FIG. 8, the stirring head 41 is moved to a position directly above the second dipping part 823 and lowered. There is no spacing compartment 822*a* in the second dipping part 823, and the probe 412 is dipped along with the cooling metals 411. Here, semi-solid metal sometimes remains in a thin film on the probe 412 after the treatment with the scraping means 81. Because the heat capacity of the probe 412 is small, the energy of the flash-boiling of the water when it is dipped is small; however, even so, the semi-solid metal in the form of a film detaches and falls from the probe 412 effectively. In other words, if it is imagined that the scraping means 81 is not there, because the heat capacity of the probe 412 is small, the flash-boiling of the water is too weak for the energy of the flash-boiling of the water on immersion to cause detachment, and consequently semi-solid metal remains on the probe 412. Therefore, the scraping means 81 is provided, and by the scraping means 81 the semi-solid metal is brought to the form of a thin film or is caused to detach completely in advance. However, so that the probe 412 is not cooled excessively, its immersion time in the second dipping part 823 is made extremely short, and is set to for example about one second.

Alternatively, spacing compartments for receiving the cooling metals 411 which water does not enter may be provided in the second dipping part 823, so that only the probe 412 is immersed. It is also possible for the probe 412 to be dipped in the second dipping part 823 before the first dipping part 822.

When treatment with the cooling means 82 finishes as described above, the stirring head 41 is carried by the stirring robot 42 (see FIG. 1) to the location of the coating means 83. The coating means 83 is provided as a liquid tank 831 containing releasing agent. The stirring robot 42 lowers the stirring head 41 from a position directly above the liquid tank 831 and immerses the cooling metals 411 and the probe 412 in the releasing agent liquid in the liquid tank 831 and thereby applies releasing agent to the cooling metals 411 and the probe 412.

When treatment with the coating means 83 finishes like this, the stirring robot 42 carries the stirring head 41 to the location of the temperature holding means 84. The temperature holding means 84 is provided as a temperature holding case 841 incorporating a heater (not shown). The stirring head 41 is lowered by the stirring robot 42 from a position directly above the temperature holding case 841, the cooling metals 411 and the probe 412 are inserted into the temperature holding case 841, and the 411, 412 are kept at a temperature of about 100° C. By this means the releasing agent applied to the cooling metals 411 and the probe 412 is dried.

After that, in FIG. 1, when a vessel 13 has been placed on the table 40 of a semi-solid metal producing apparatus 14 by the carrying robot 16 and melt has been poured into this vessel 13 by the melt scooping robot 12, the stirring head 41 is pulled up from the temperature holding means 84 (see FIG. 8) and moved to above the table 40, and production of semi-solid metal is started.

Because the vessel 13 and the stirring head 41 have been restored well to a required state by the vessel restoring apparatus 17 and the stirring head restoring apparatus 18 as described above, semi-solid metal can be made well and the quality of the metal molded product improves.

Figure 11:
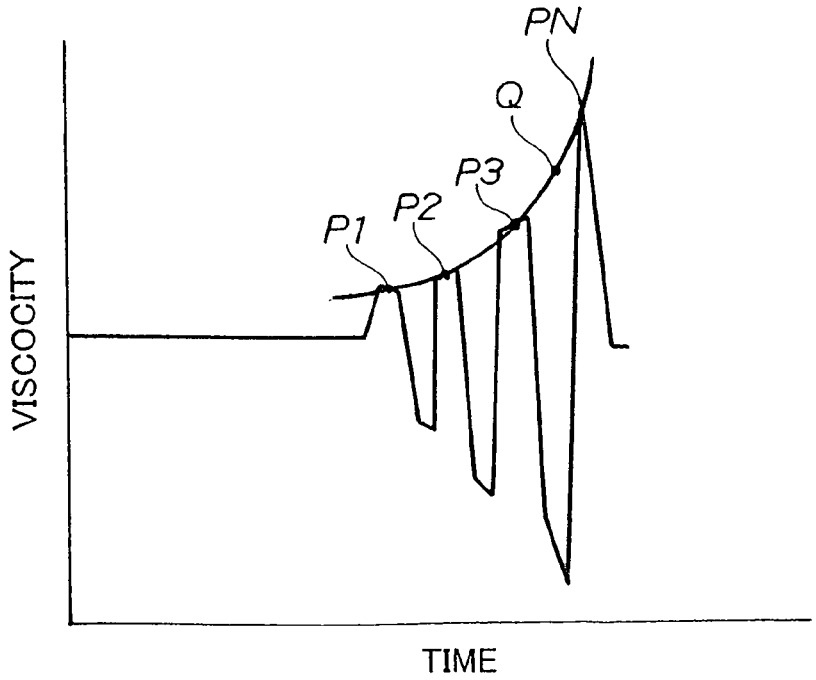
FIG. 11 is a graph obtained by investigating viscosity change of a semi-solid metal with time.

In FIG. 11, using the apparatus of FIG. 2, the viscosity of semi-solid metal in a vessel was investigated. In the initial stages of stirring and cooling, because it is not possible to measure a stable viscosity due to noise being great immediately after the stirring means is deployed, viscosities of after the initial noise was cut are shown.

As a characteristic of the apparatus, the probe repeatedly moves, stops, and changes direction. Consequently, the graph goes up and down in waves only the data of when the probe is moving in the same direction at the same speed is taken out. That is, when the+side peaks P1, P2 . . . , PN are joined together, a curve Q rising to the right can be obtained.

Now, the semi-solid metal is a mixture of liquid phase and solid phase, and as time passes its temperature falls and the liquid phase solidifies and the proportion of solid phase increases. As a result, with time its viscosity increases. Therefore, a curve similar to the curve Q is obtained even if the horizontal axis is changed to solid phase percentage. The next figure was obtained by arranging the data on the basis of this thinking.

Figure 12:
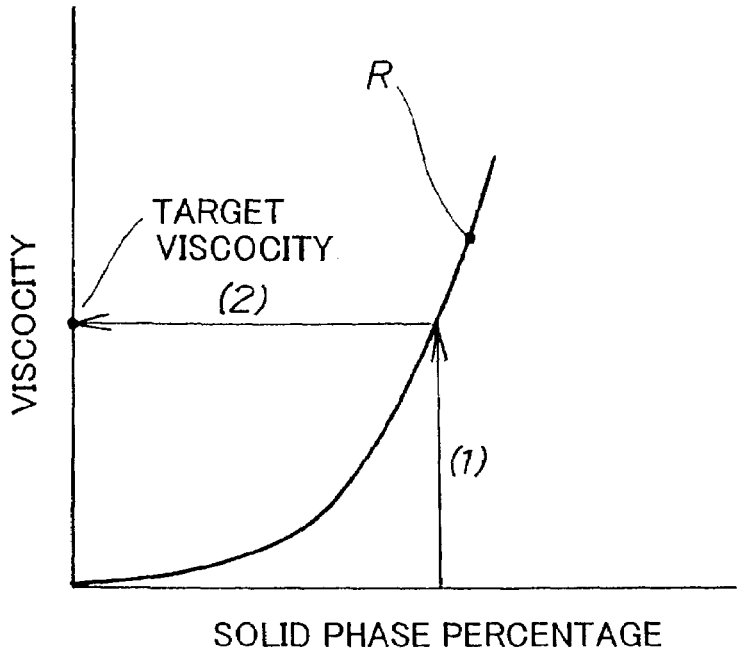
FIG. 12 is a graph showing a correlation between solid phase percentage and viscosity of a semi-solid metal.

In FIG. 12, the horizontal axis is solid phase percentage and the vertical axis shows viscosity, and a curve R rising to the right can be drawn there. If this curve R is drawn up for each type of alloy, a target viscosity A can be obtained in the following way.

For example a target solid phase percentage of an aluminum alloy melt to be an aluminum alloy die casting starting material shown on the horizontal axis is decided, the point of intersection with the graph of a line extending vertically upward (1) from that target solid phase percentage is obtained, and a line (2) intersecting orthogonally with the viscosity axis is extended from that intersection point and its point of intersection with the viscosity axis decided as a target viscosity A.

By preparing a map showing the correlation between solid phase percentage and viscosity of the slurry-form semi-solid metal for each metal composition, it is possible to determine a target viscosity corresponding to the target solid phase percentage in advance, and it is possible to make the subsequent steps proceed smoothly.

Figure 13:
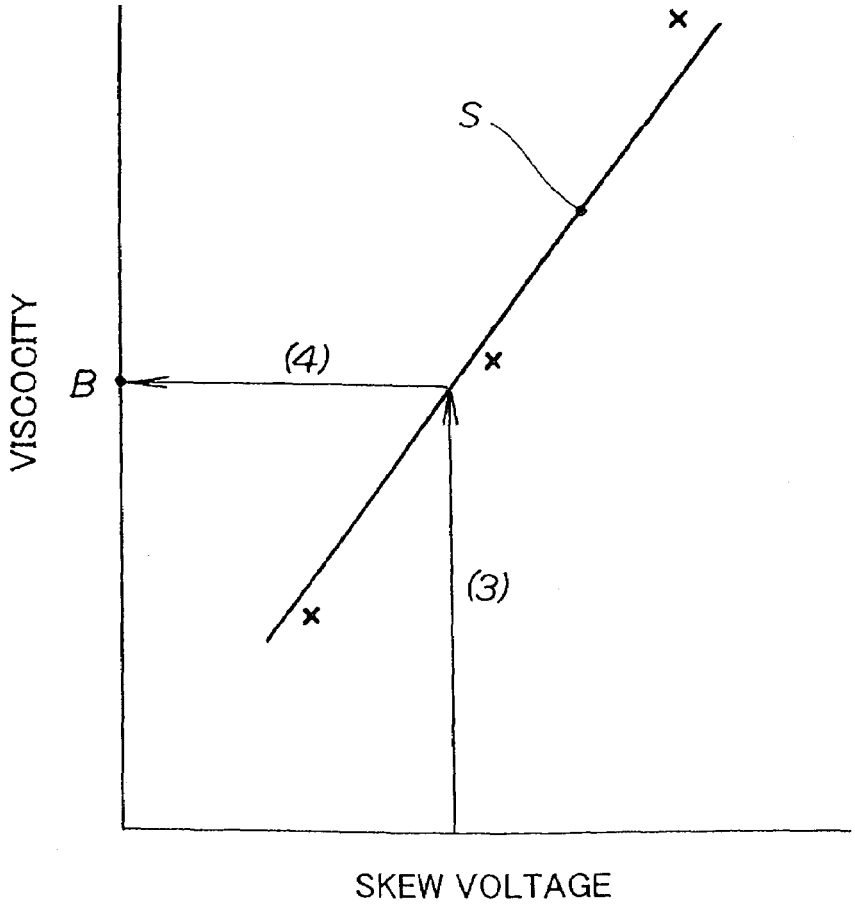
FIG. 13 is a graph showing a correlation between skew voltage and viscosity.

In FIG. 13, using the apparatus explained with reference to FIG. 2, a curve S was obtained by measuring skew voltage with respect to fluids of known viscosities and plotted these measured values (the x marks). With this curve S, it is possible to obtain from the measured values (of skew voltage) a viscosity B of that time in the following way.

The skew voltage measured by the load cell is taken on the horizontal axis, the point of intersection with the graph of a line (3) extending vertically upward from the measured skew voltage is obtained, and a line (4) intersecting with the viscosity axis from that intersection point is drawn and its point of intersection with the viscosity axis is taken as the viscosity B.

Figure 14:
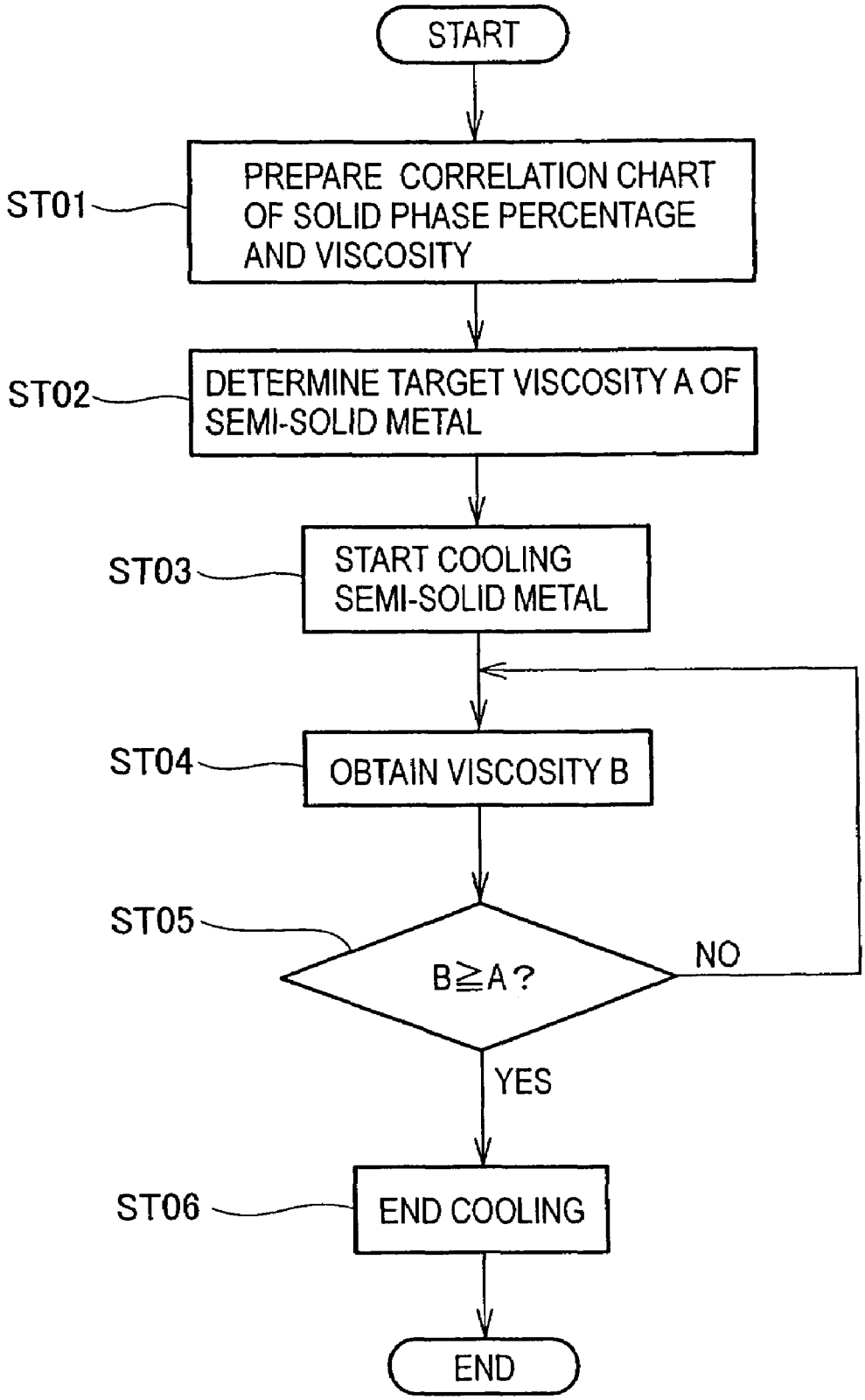
FIG. 14 is a flow chart showing a semi-solid metal solid phase percentage management method.

FIG. 14 shows a flow chart of a semi-solid metal solid phase percentage management method according to the invention. STxx indicates a step number.

ST01: First, a chart of correlation between solid phase percentage and viscosity of the semi-solid metal is prepared by metal composition (see FIG. 12).

ST02: Using the correlation chart prepared in ST01, a target viscosity A corresponding to a target solid phase percentage is set (see FIG. 12).

ST03: Cooling of semi-solid metal being stirred in a vessel is commenced.

ST04: As the semi-solid metal is cooled, a skew voltage is measured with the load cell, and a viscosity B is obtained by the force—viscosity conversion means (see FIG. 13).

ST05: If the viscosity B obtained in step ST04 is above the target viscosity A, the process proceeds to ST06 and cooling is ended, but if the viscosity B is less than the target viscosity A then cooling is continued until the target viscosity A is reached.

In this way, because in the method of the invention the solid phase percentage is managed by detecting a target viscosity A, the affects of cooling rate changes and time can be eliminated, and it is possible to raise management accuracy of the solid phase percentage of the semi-solid metal much further than with related art management based on time.

Figure 15:
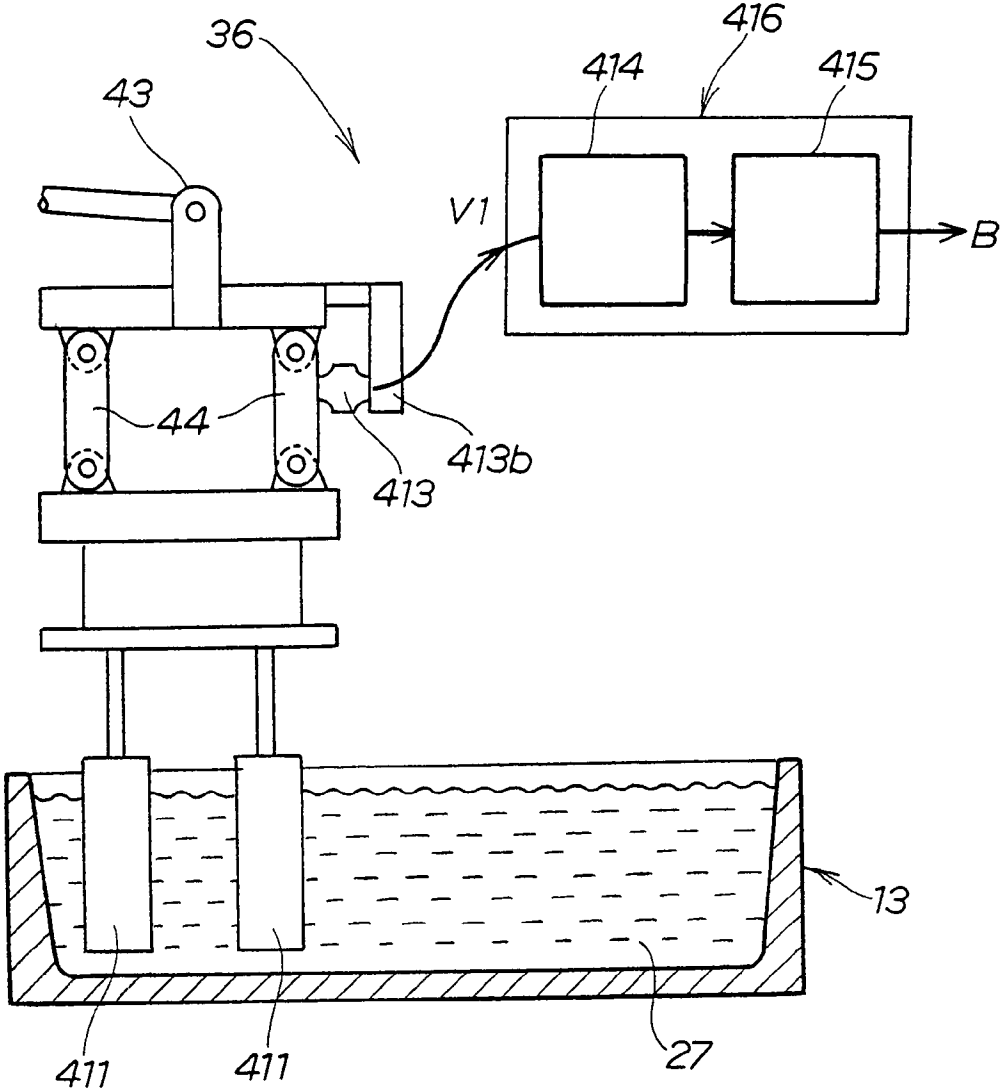
FIG. 15 is view of another embodiment of a viscosity measuring apparatus.

In another embodiment of FIG. 2 shown in FIG. 15, a viscosity measuring apparatus 36 transmits the force received by the cooling metals 411, 411 from the semi-solid metal 27 to the load cell 413 via a link mechanism 44 moved using a robot arm 43. The load cell 413 recognizes the force received from the semi-solid metal 27 via the link mechanism 44 as a skew voltage V1. After that, the skew voltage V1 is converted into a viscosity B by the force-viscosity converting means 416.

In this case, because the viscosity measuring apparatus 36 transmits the force received from the cooling metals 411, 411 moving inside the vessel 13 via a link mechanism 44 moved using a robot arm 43, it is not necessary for the load cell 413 to be connected to a probe 412 (not shown), and it is not necessary to specify the position of a probe 412.

Figure 16:
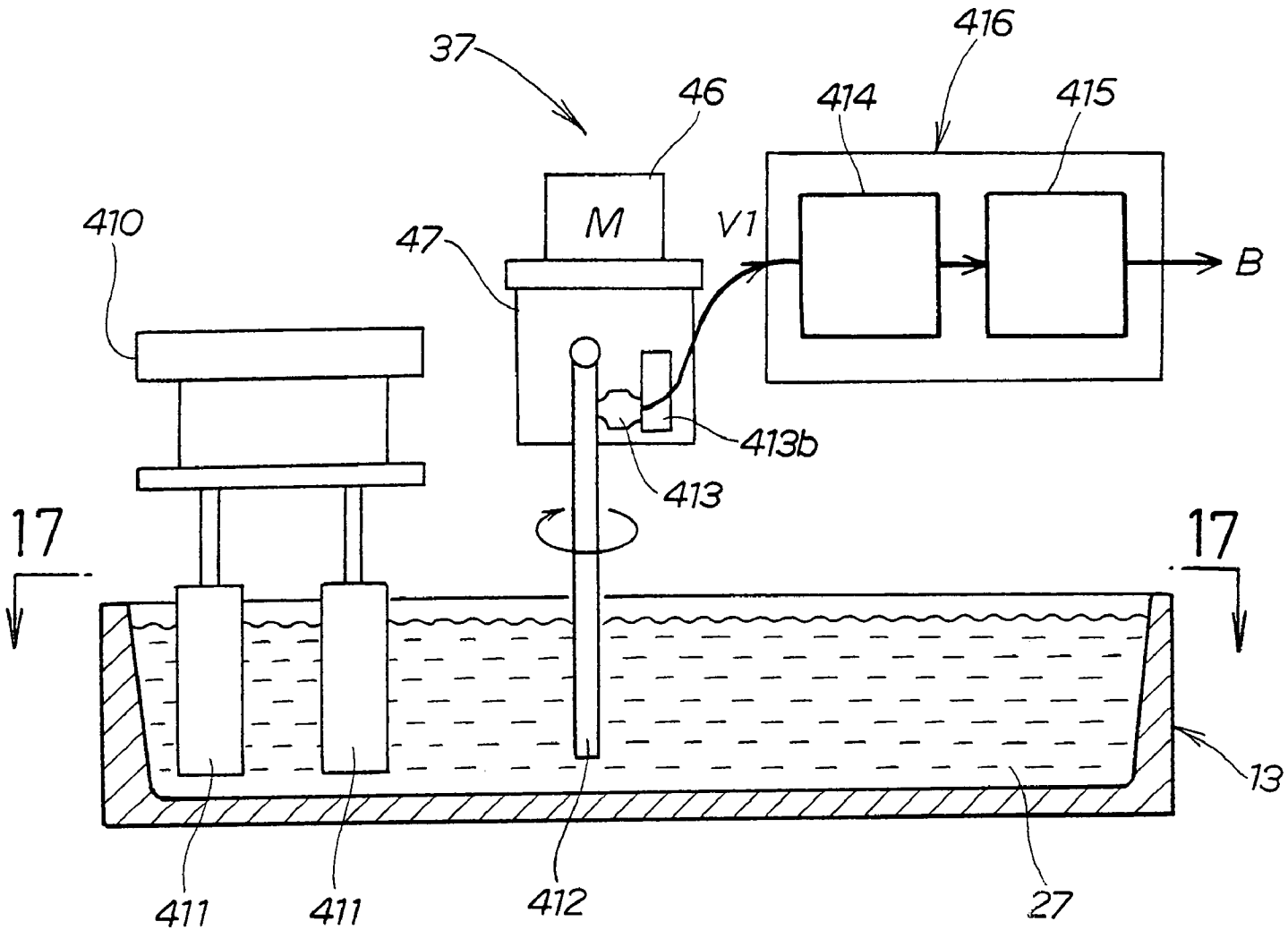
FIG. 16 is a view of a further embodiment of a viscosity measuring apparatus.

In a further embodiment of FIG. 2 shown in FIG. 16, a viscosity measuring apparatus 37 is made up of cooling metals 411, 411; a probe 412 in the form of a cantilever beam; a load cell 413 for measuring a force received by the probe 412; a bracket 413*b* to which this load cell 413 is fixed; a fixed member 47 to which the probe 412 is attached; a motor 46 for rotating the fixed member 47 integrally with the probe 412, the load cell 413 and the bracket 413*b*; and force-viscosity converting means 416 having force converting means 414 for converting a physical quantity from the load cell 413 into a viscosity and viscosity converting means 415.

That is, in FIG. 16, the point that the probe 412 is not integral with the cooling metal moving means 410 shown in FIG. 2 is the difference from FIG. 2, and this probe 412 performs the role of transmitting a force received from the semi-solid metal 27 to the load cell 413 by being rotated by the motor 46. The load cell 413 recognizes the force that the probe 412 receives from the semi-solid metal 27 as a skew voltage V1. After that, the skew voltage V1 is converted into a viscosity B by the force—viscosity converting means 416.

In this case, because the probe 412 is further rotated by the motor 46 in the semi-solid metal 27 having been stirred to a constant viscosity by the cooling metals 411, 411 moving inside the vessel 13, it can transmit a force received from a melt in a uniform state to the load cell 413.

Figure 17:
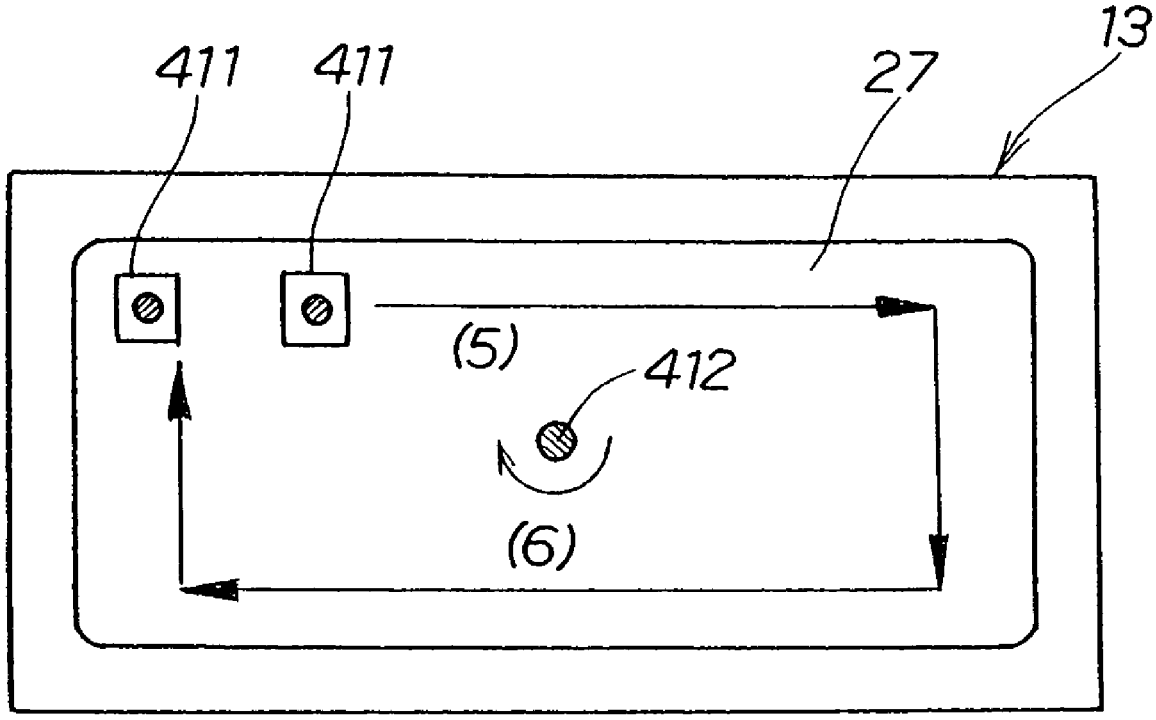
FIG. 17 is a view in the direction of the arrows 17-17 in FIG. 16.

In FIG. 17 there are cooling metals 411, 411 and a probe 412 disposed in the middle of the semi-solid metal 27 in a vessel 13. The cooling metals 411, 411 move in the semi-solid metal 27 in a rectangle as shown by the arrows (5) and stir the semi-solid metal 27 in the vessel 13. At the same time, the probe 412 is moved by the motor so as to describe a circular arc as shown by the arrow (6), and stirs the semi-solid metal 27 around the probe 412.

As the cooling metals 411, 411 stir the semi-solid metal 27 in the vessel 13 in a rectangle, the probe 412 stirs the semi-solid metal 27 by describing a circular arc in the middle of the semi-solid metal 27. As a result, the probe 412 can transmit to the load cell 413 a force received from melt in an amply uniform state stirred by both the cooling metals 411, 411 and the probe 412 itself.

Although in the viscosity measuring apparatus of this invention the cooling metals 411, 411 do not move relative to each other and are fixed as they move in a rectangle in the semi-solid metal 27, alternatively the cooling metals 411, 411 themselves may move by autorotating or revolving as they move in the semi-solid metal 27.

Even if the cooling metals 411, 411 and the cooling metal moving means 410 including the cooling metals 411, 411 do a movement other than a rectangle (for example a zigzag movement) in the semi-solid solid metal 27, as long as there is a small part where their speed is constant this is acceptable.

Figure 18:
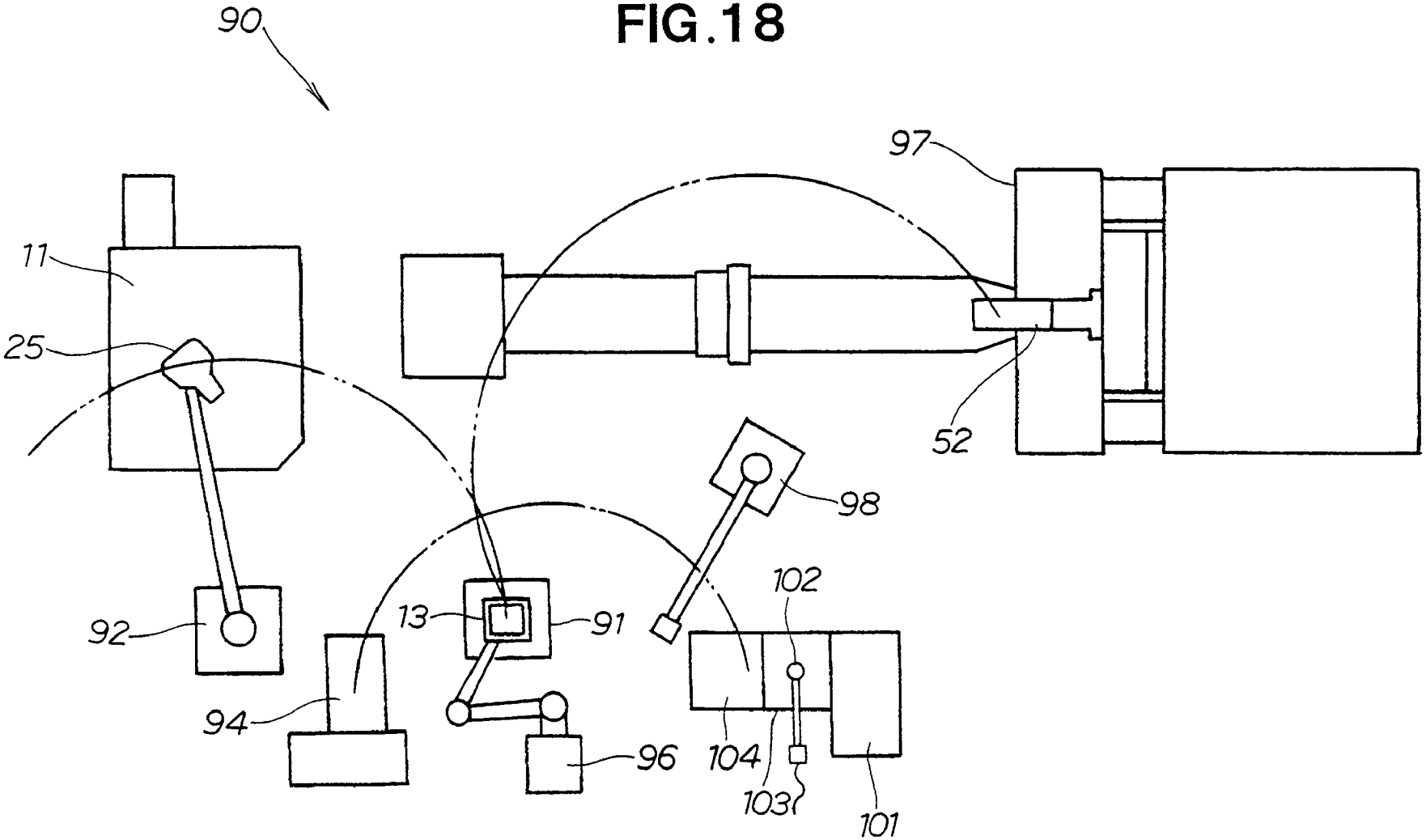
FIG. 18 is a layout view of a semi-solid metal injection-molding plant according to the invention.

In FIG. 18, a production line 90 is made up of a melt holding furnace 11 for holding a metal at a temperature above its melting point; a ladle 25 to which one shot's worth of melt is supplied from this melt holding furnace 11; a first robot 92 for transporting this ladle 25 to a central table 91; a vessel 13 placed on the central table 91; stirring means 93 (not shown; details will be discussed later) for stirring melt in this vessel 13; a stirrer restoring table 94 for restoring this stirring means 93 by removing melt and so on adhered to it; a second robot 96 for moving the stirring means 93 back and forth between the stirrer restoring table 94 and the central table 91; an injection-molding mechanism 97 serving as a molding machine having an injection sleeve 52; a third robot 98 for transporting the vessel 13 to the injection sleeve 52; a maintenance table 101 for cleaning and coating empty vessels 13; a cooling table 103 having an air blowing nozzle 102 for cooling a cleaned and coated vessel 13; and a heating table 104 for heating a vessel 13 at the start of operation.

The vessel 13 is preferably a heat-resistant steel casting. For example SCH12 is a stainless cast steel including 8 to 12% Ni and 18 to 23% Cr and has good heat-resistance. Detailed data will not be given here, but six times the life (in shots) of an ordinary carbon steel (SS400-JIS) vessel was obtained.

Whereas the thermal conductivity of carbon steel is 60.7 W/m.K, the thermal conductivity of SCH12 is 14.7 W/m.K.

When the thermal conductivity of the vessel is large, with respect to the center of the melt the edges of the melt (the parts in contact with the vessel) become considerably cooler, and a temperature difference arises in the melt.

On this point, if it is an SCH12 vessel, its thermal conductivity is low and the temperature difference between the center of the melt and the edges is small. That is, it has the merit that the temperature of the melt readily becomes uniform, and temperature management becomes easy.

The operation of a production line 90 having the construction described above will now be described.

Figure 19:
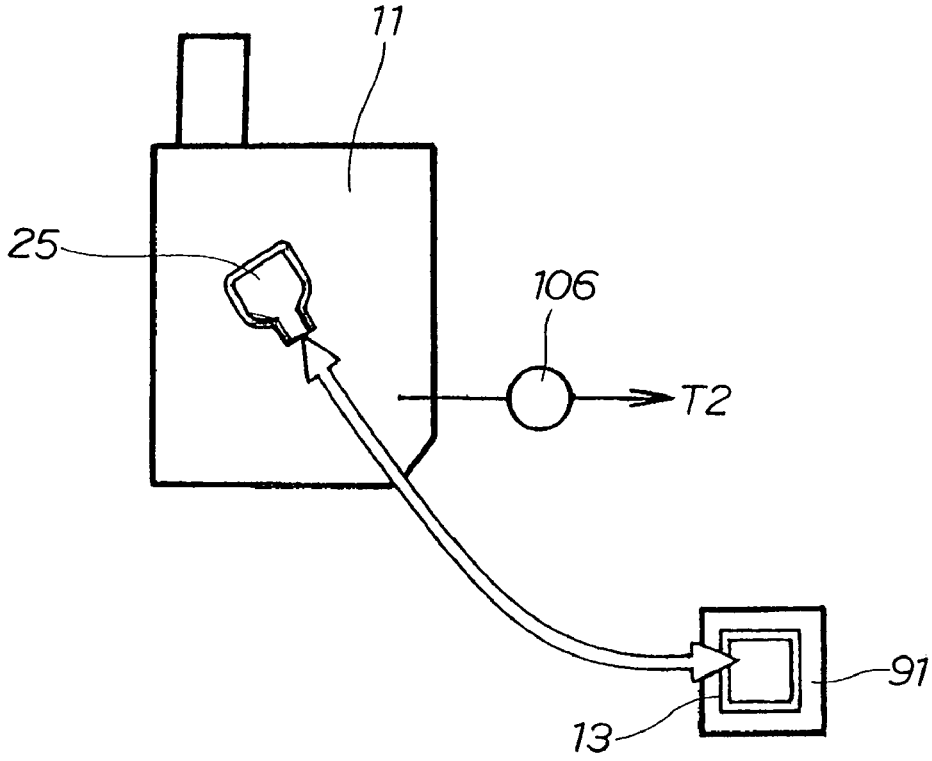
FIG. 19 is an operation view of a ladle.

In FIG. 19, melt is scooped from the melt holding furnace 11 with the ladle 25 and poured into a vessel 13 placed on the central table 91. The temperature T2 of the melt holding furnace 11 is measured with a temperature sensor 106.

Figure 20:
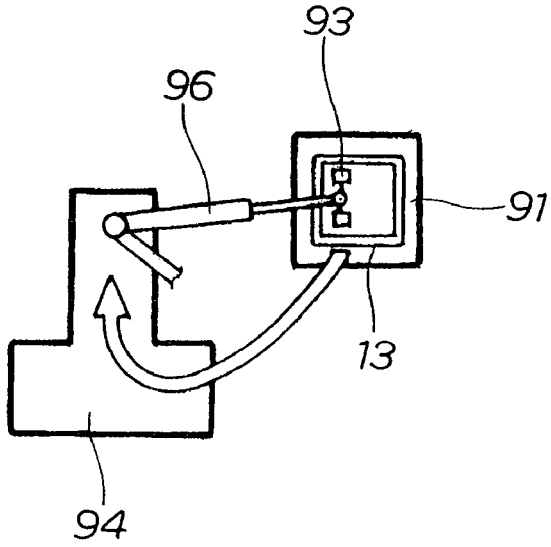
FIG. 20 is an operation view of stirring means.

In FIG. 20, the stirring means 93 standing by at the stirrer restoring table 94 is moved to the central table 91, there stirs the melt in the vessel 13, and when finished returns to the stirrer restoring table 94.

Figure 21:
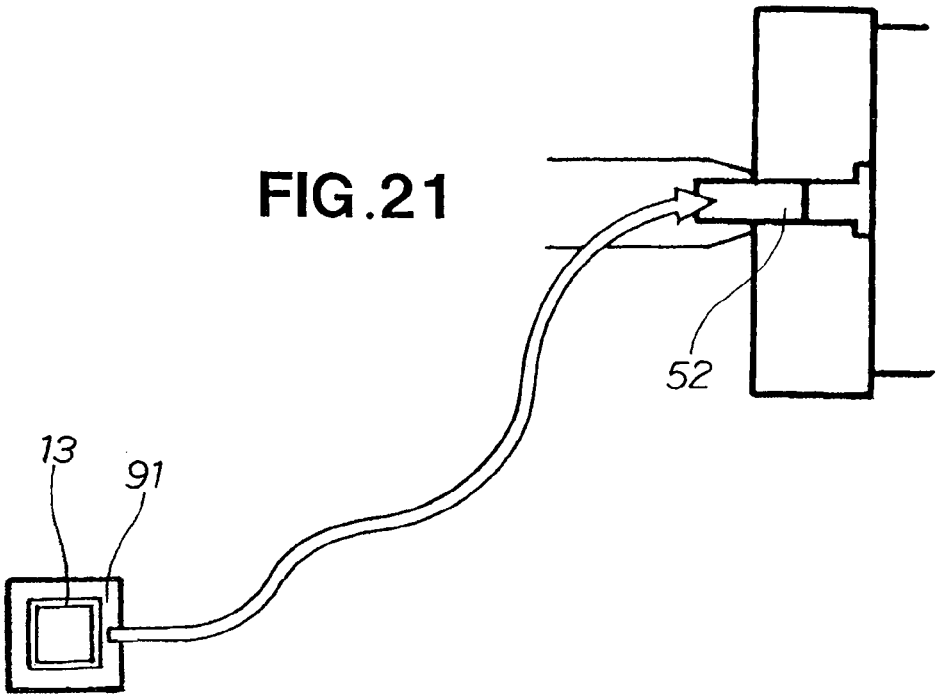
FIG. 21 is an operation view of a vessel.

In FIG. 21, a vessel 13 containing melt adjusted to a target solid phase percentage semi-solid metal is moved to the injection sleeve 52 and poured into the injection sleeve 52.

Figure 22:
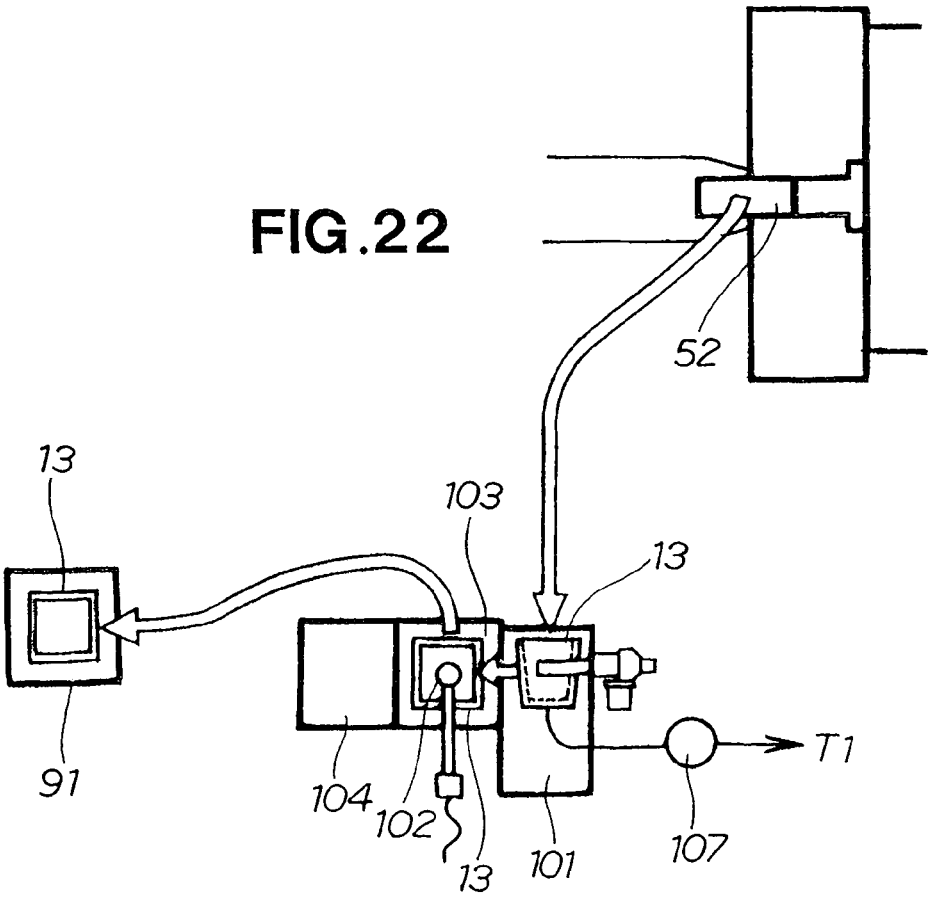
FIG. 22 is an operation view of an empty pouring vessel.

In FIG. 22, the emptied vessel 13 is moved to the maintenance table 101 and there residuum is removed and then coating is carried out. At that stage the temperature T1 of the vessel 13 is measured with a temperature sensor 107.

The vessel 13 is moved to the cooling table 103, and there air-cooling is carried out for a predetermined time by air being blown from the air blowing nozzle 102. When the cooling finishes, the vessel 13 is returned to the central table 91.

Next, a correlation chart showing the relationship between the temperature of the vessel and the temperature of the melt holding furnace and the air blowing time is prepared. An example of the correlation chart prepared is shown in the next figure.

Figure 23:
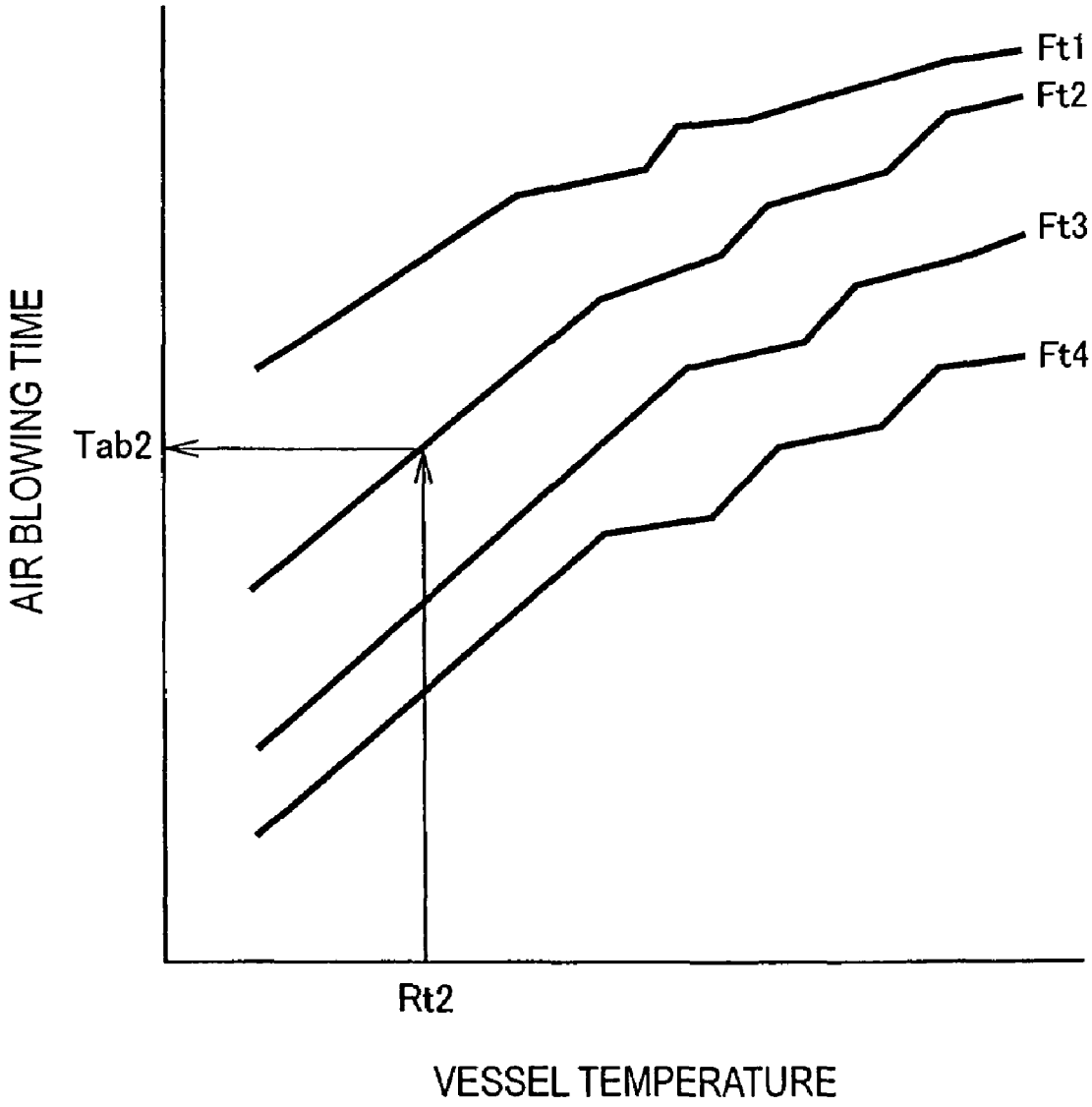
FIG. 23 is a correlation graph of vessel temperature—melt holding furnace temperature—air blowing time pertaining to the invention.

In FIG. 23, explaining how the correlation graph is used, if the temperature of the vessel measured in mid-production is Rt2 and temperature of the melt holding furnace (Ft1 to Ft4) is for example Ft2, then the air blowing time that should be set is Tab2.

If air blowing is carried out for the time Tab2 and the vessel is returned to the central table and melt is supplied to this vessel and stirred with the stirring means, the stirring time to a fixed viscosity being reached is a substantially fixed time.

A manufacturing flow using this correlation graph will be described with reference to FIG. 24 and FIG. 25.

Figure 24:
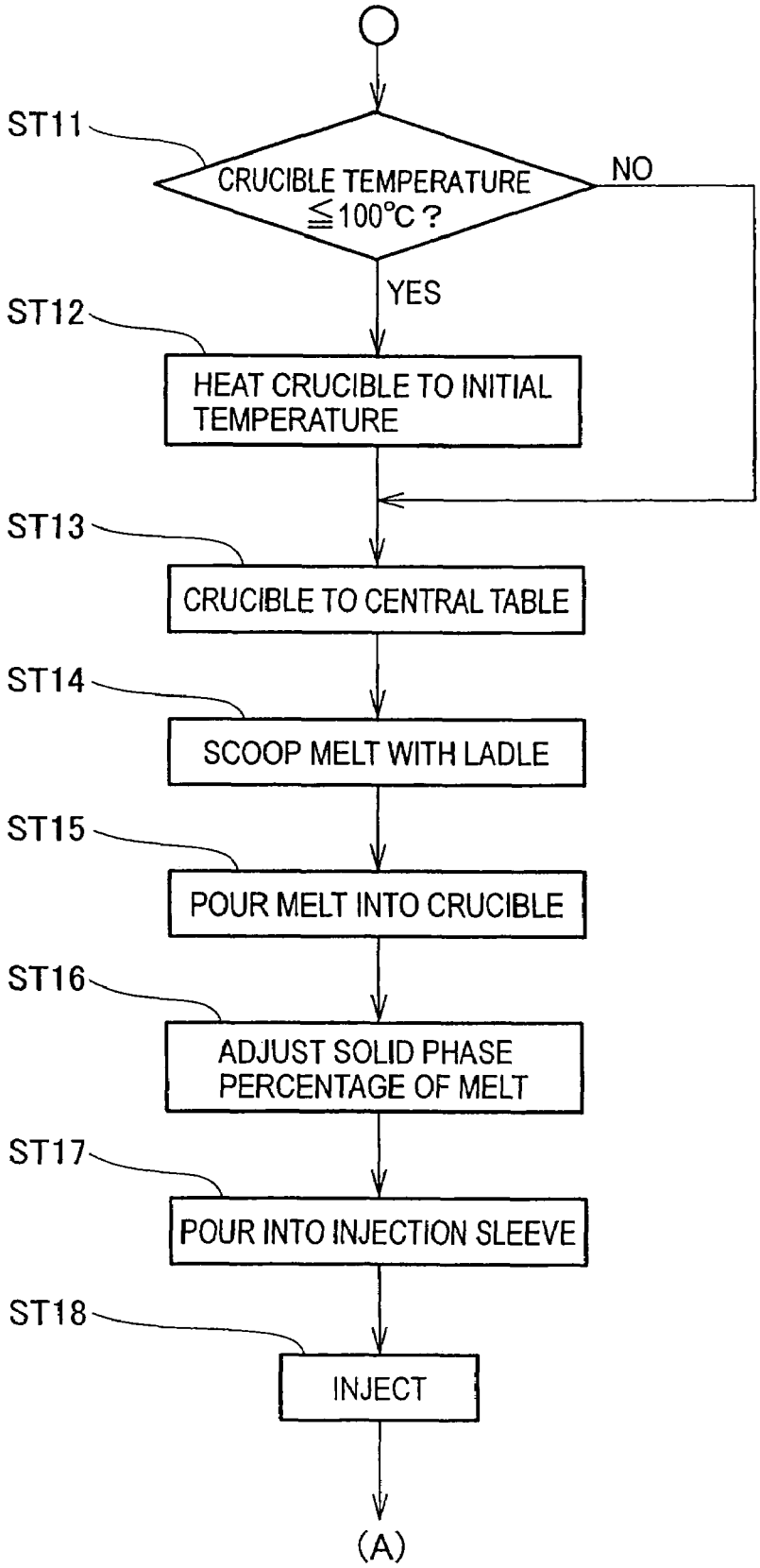
FIG. 24 is a production flow chart up to injection.
Figure 25:
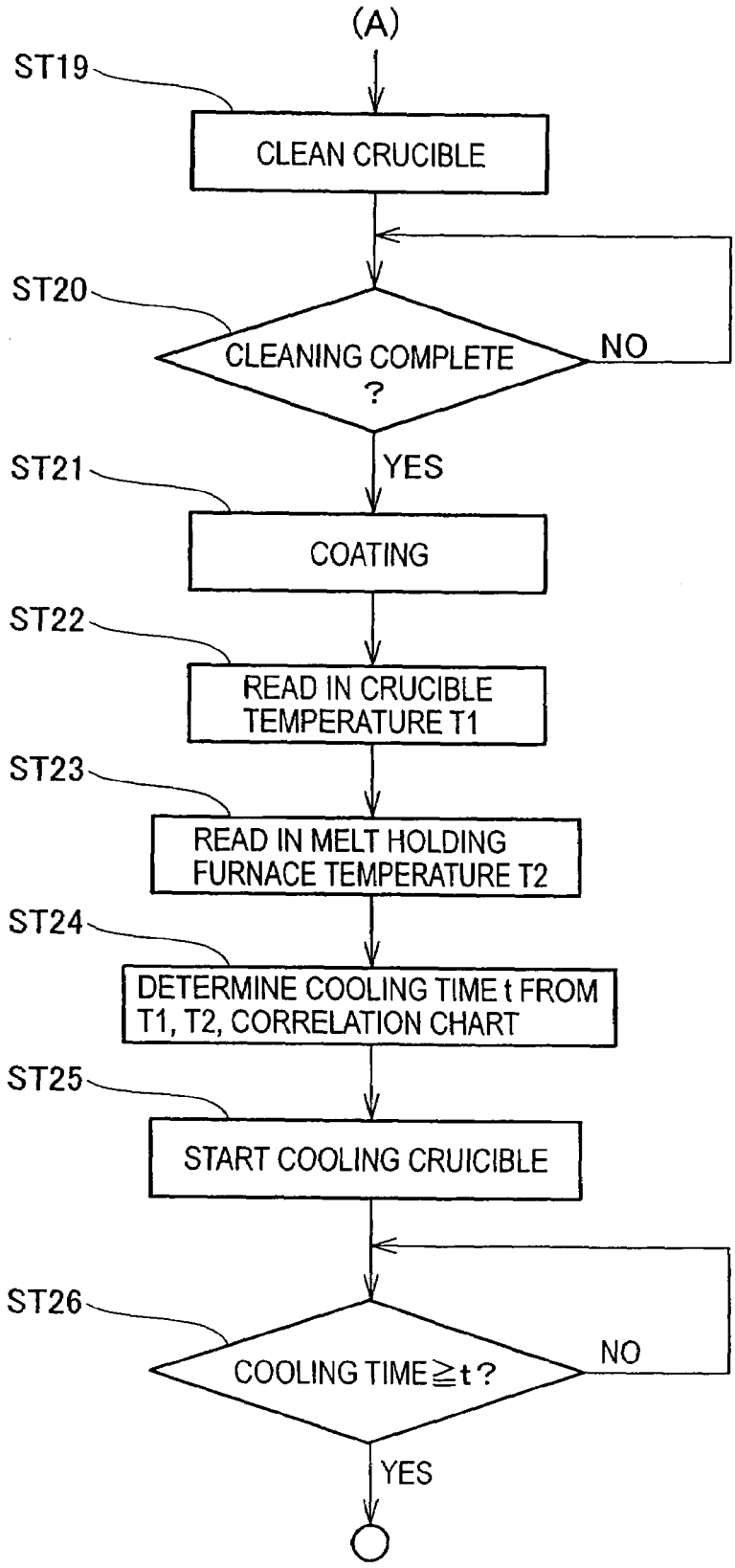
FIG. 25 is a production flow chart up to vessel cooling.

In FIG. 24 and FIG. 25, the vessel is described using the name 'crucible'. First, FIG. 24 will be explained.

ST11: Because the crucible is at room temperature the first time, it is necessary for it to be heated to a predetermined initial temperature. To check whether or not it is the first time for the crucible, it is checked whether or not the crucible temperature is below 100° C. If it is above 100° C. it is deemed that heating is not necessary, and the process moves on to ST13.

ST12: When in ST11 it is below 100° C., the crucible is heated to the initial temperature.

ST13: The crucible is placed on the central table.

ST14: Melt is scooped from the melt holding furnace with the ladle.

ST15: The melt is supplied to the crucible.

ST16: Adjustment of the solid phase percentage of the melt is carried out immediately.

ST17: The adjusted melt is poured into the injection sleeve.

ST18: Injection is carried out, and a molding is obtained.

FIG. 25 shows the production flow to crucible cooling.

ST19: The crucible is cleaned.

ST20: This is carried out any number of times, until cleaning is complete.

ST21: Coating of the crucible is carried out.

ST22: The temperature T1 of the crucible (corresponding to Rt2 in FIG. 23) is read in.

ST23: The temperature T2 of the melt holding furnace (corresponding to Ft2 in FIG. 23) is read in.

ST24: From the temperature T1 of the crucible, the temperature T2 of the melt holding furnace and the correlation chart (see FIG. 23), a cooling time t (corresponding to Tab2 in FIG. 23) is determined.

ST25: Cooling of the crucible is started.

ST26: When the time reaches t, cooling is ended.

Figure 26:
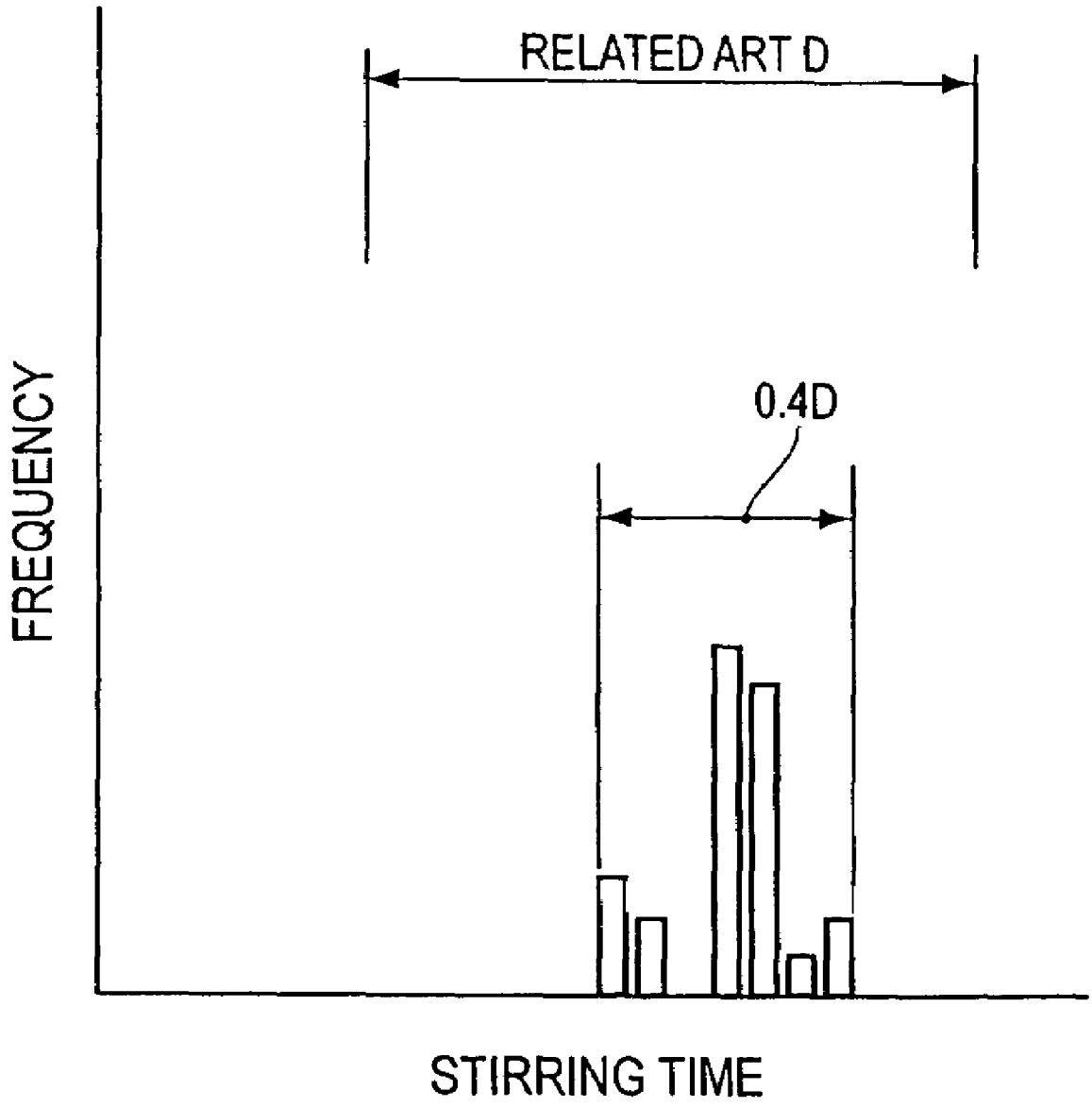
FIG. 26 is a graph showing dispersion in melt stirring time.

In FIG. 26, the horizontal axis shows stirring time and the vertical axis shows frequency.

Although it will not be discussed in detail, in related art technology the variation in the stirring time was D. With respect to this, with the present invention, the variation in the stirring time was reduced to 0.4×D, that is, 40% of that in the related art.

Thus it can be said that it is possible to greatly improve variation in stirring time with this invention.

The correlation graph described in this embodiment (the correlation graph of vessel temperature—melt holding furnace temperature—air blowing time) may alternatively be a mathematical correlation expression or a tabulated correlation chart, and because it can be of any form it will be referred to as a correlation chart.

Also, the method of making the correlation chart is not limited to that described in this embodiment.

A mode of practicing a die casting method in which the semi-solid metal described above is poured will now be described with reference to the accompanying FIG. 27 to FIG. 34. The die casting method of this practicing mode is for casting a cylinder block 110 constituting a constituent part of a multi-cylinder engine using an aluminum semi-solid metal in the form of a slurry, and it is manufactured using a casting mold 112 (see FIG. 29). First, the cylinder block 110 will be described.

Figure 27:
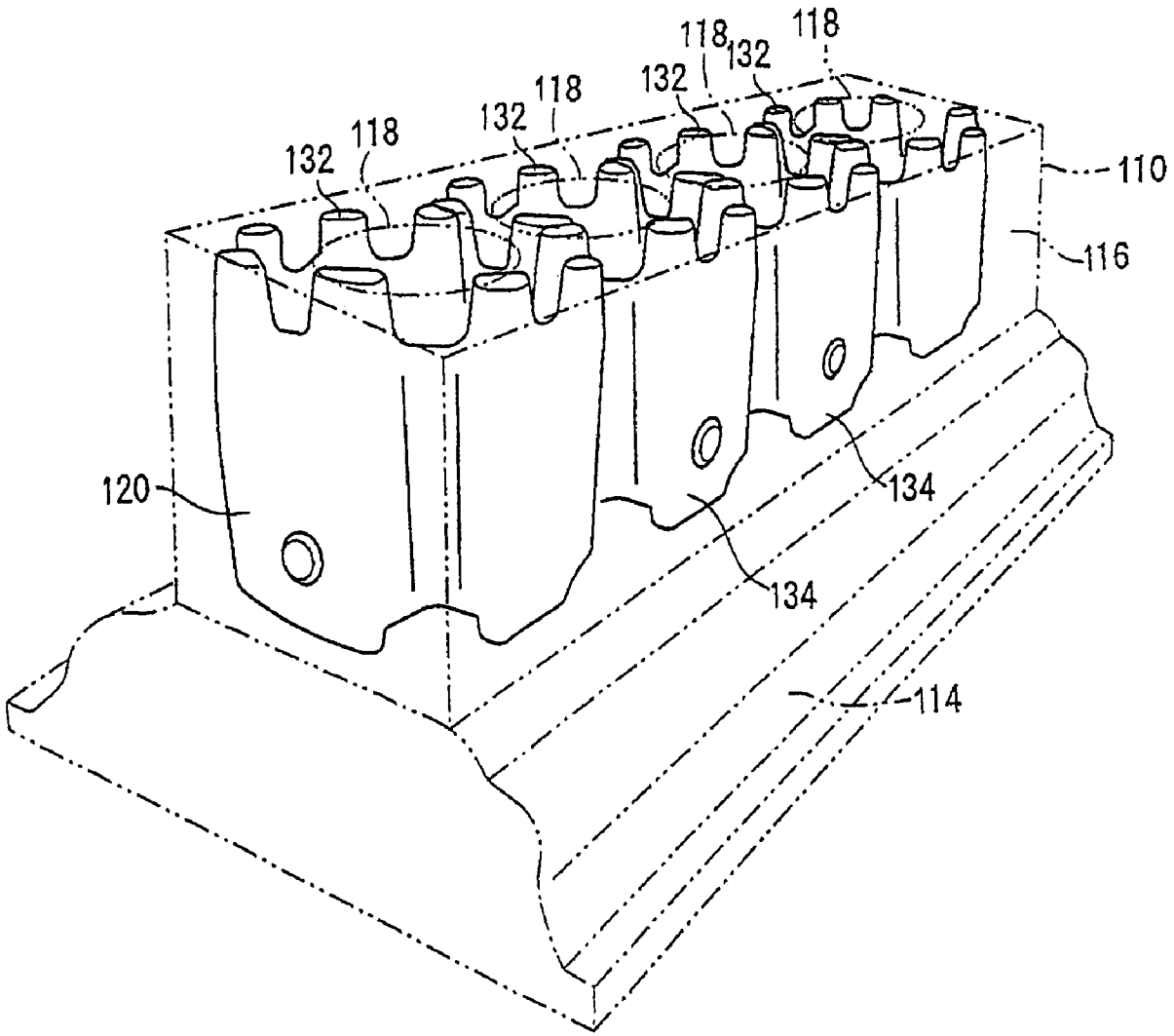
FIG. 27 is a schematic perspective view of a cylinder block cast with a casting mold.
Figure 28:
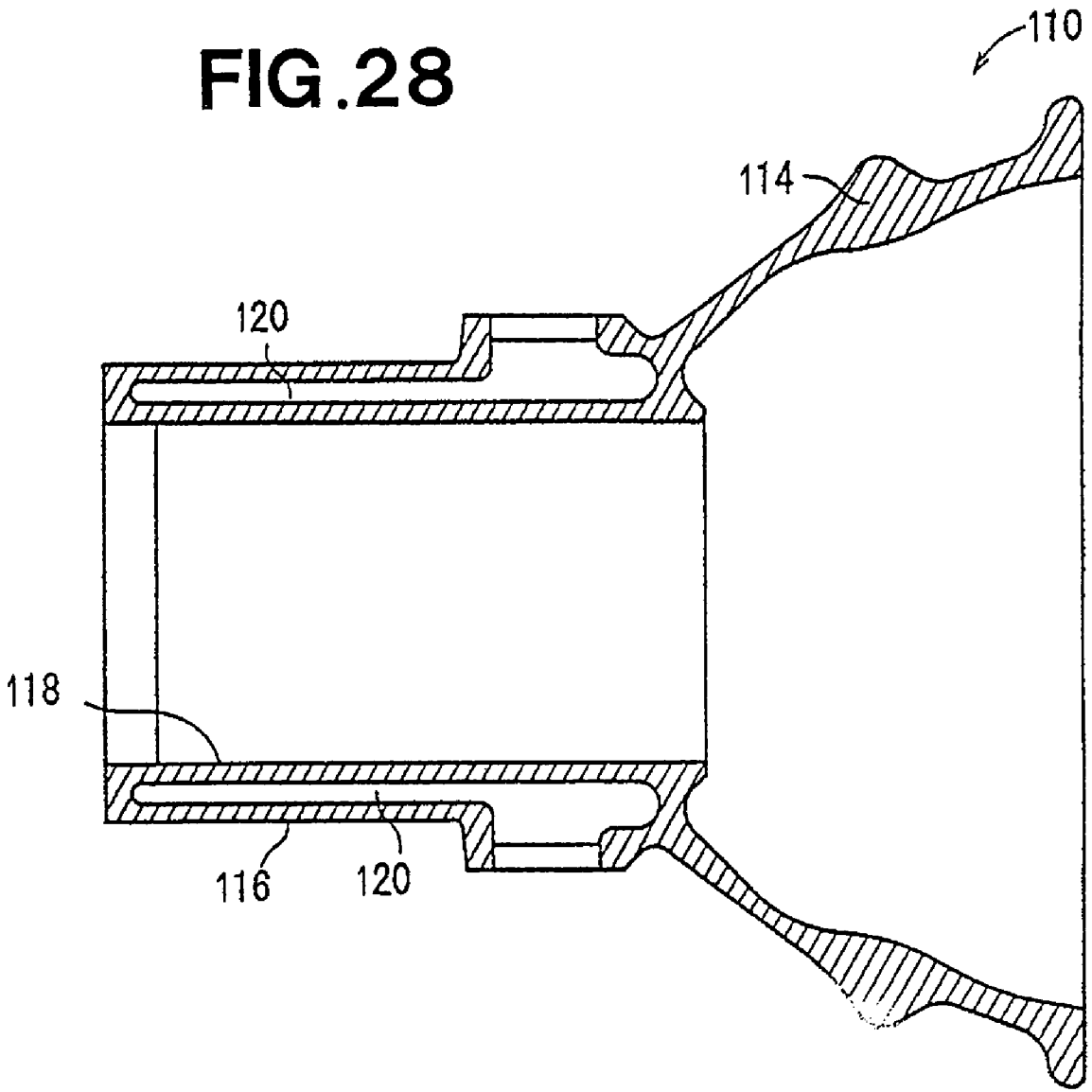
FIG. 28 is a side view of a cylinder block cast with a casting mold.

As shown in FIG. 27 and FIG. 28, the cylinder block 110 has a crank case part 114 and a cylinder wall 116 extending from the crank case part 114. Four cylinder bores 118 are provided in a straight line in the cylinder wall 116. The cylinder block 110 is a semi-closed type, and parts of a water jacket 120 are open at a cylinder head face and an outer face of the cylinder wall 116.

Cylinder pistons (not shown) fit slidably in the cylinder bores 118.

Figure 29:
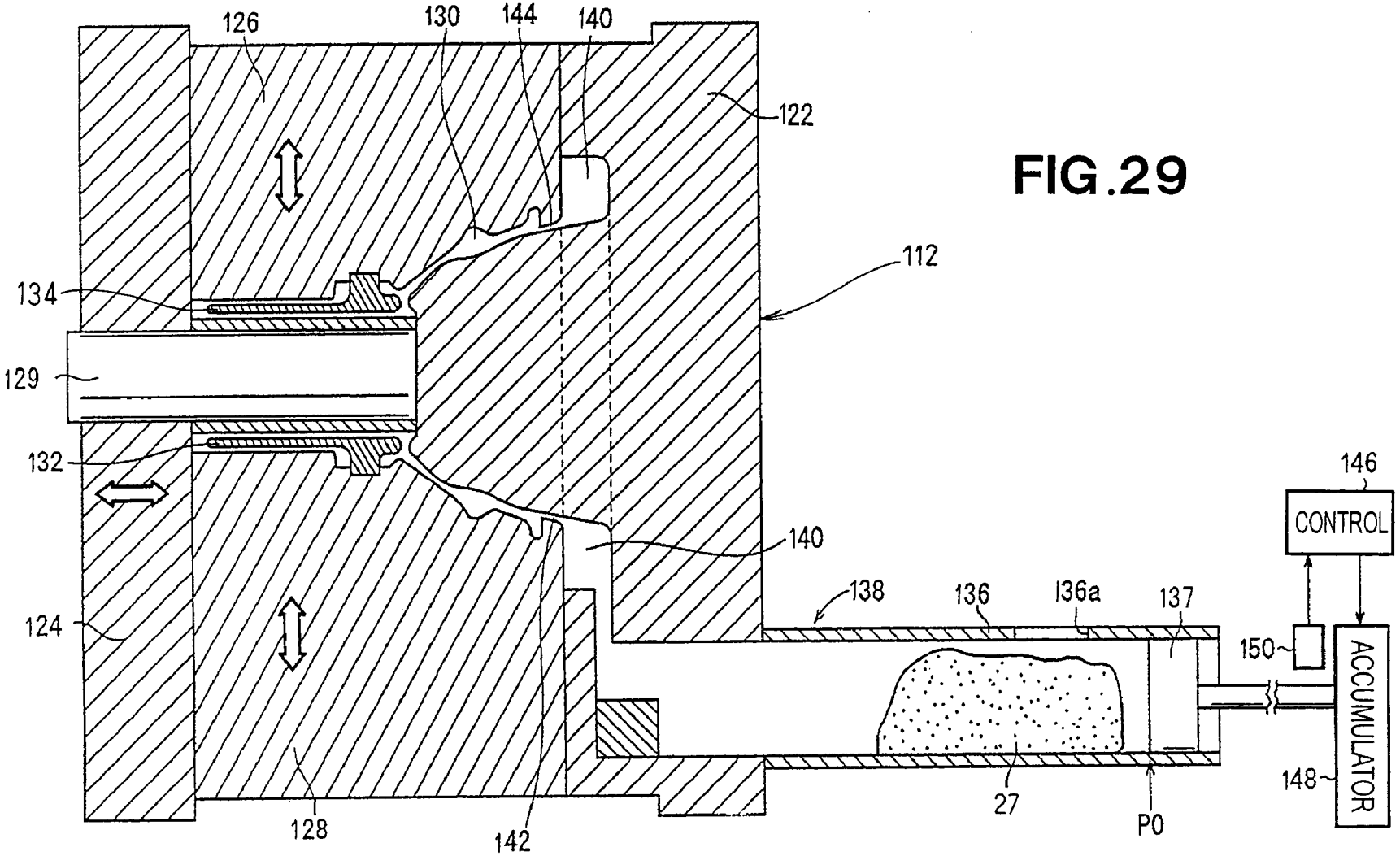
FIG. 29 is a sectional side view showing a casting mold with an injection piston disposed at a starting position.

As shown in FIG. 29, the casting mold 112 has a fixed die 122 on the crank case side, a moving die 124 on the cylinder head side, and sliding dies 126, 128 that move on rails to form side faces of the cylinders. The moving die 124 can be advanced and retracted in a direction perpendicular to the fixed die 122, and the sliding die 126 can slide along the face of the fixed die 122. Insert pins 129 for forming bores project from the moving die 124.

A cavity 130 that is a central space surrounded and formed by the fixed die 122, the moving die 124, the sliding dies 126, 128 and the insert pins 129 has a shape corresponding to the cylinder block 110 (see FIG. 28), and a cylinder block 110 is obtained by an aluminum alloy semi-solid metal 27 being poured into the cavity 130 and hardening. Sand cores 132, 134 for molding the water jacket 120 (see FIG. 28) are provided in the cavity 130 and held by the sliding dies 126, 128. The sand cores 132, 134 are formed narrowly within the width of the cylinder wall 116 (see FIG. 28), and are set so as to substantially cover the bore part, and are formed so that they can be crumbled and removed easily after casting. Vent parts not shown in the figures are provided in the cavity 130.

The casting mold 112 has a gate 138 having an injecting piston 137 for injecting semi-solid metal 27 in an injection sleeve 136, and a runner 140 constituting a passage through which semi-solid metal 27 supplied through the gate 138 is supplied to the cavity 130. An opening 136*a* through which semi-solid metal 27 is fed is provided in the upper face of the injection sleeve 136 near the end thereof.

Here, the semi-solid metal 27 is one obtained by bringing a metal (including alloys) to a semi-solid state or one obtained by cooling and stirring a metal melt to a semi-solid state, and refers to both those brought to a semi-solid state by heating the metal directly and those brought to a semi-solid state by cooling after once being melted completely. The semi-solid metal 27 like this is in a solid-liquid coexistence state.

The runner 140 is connected to the cavity 130 via weirs 142, 144.

The injecting piston 137 is driven by an accumulator 148 (a hydraulic cylinder or the like) under the action of a control part 146, and the position of the injecting piston 137 is detected by a sensor 150 and supplied to the control part 146. In the control part 146, on the basis of a signal supplied from the sensor 150 the position and speed of the injecting piston 137 are recognized, and on the basis of these parameters the accumulator 148 is operated.

Figure 30:
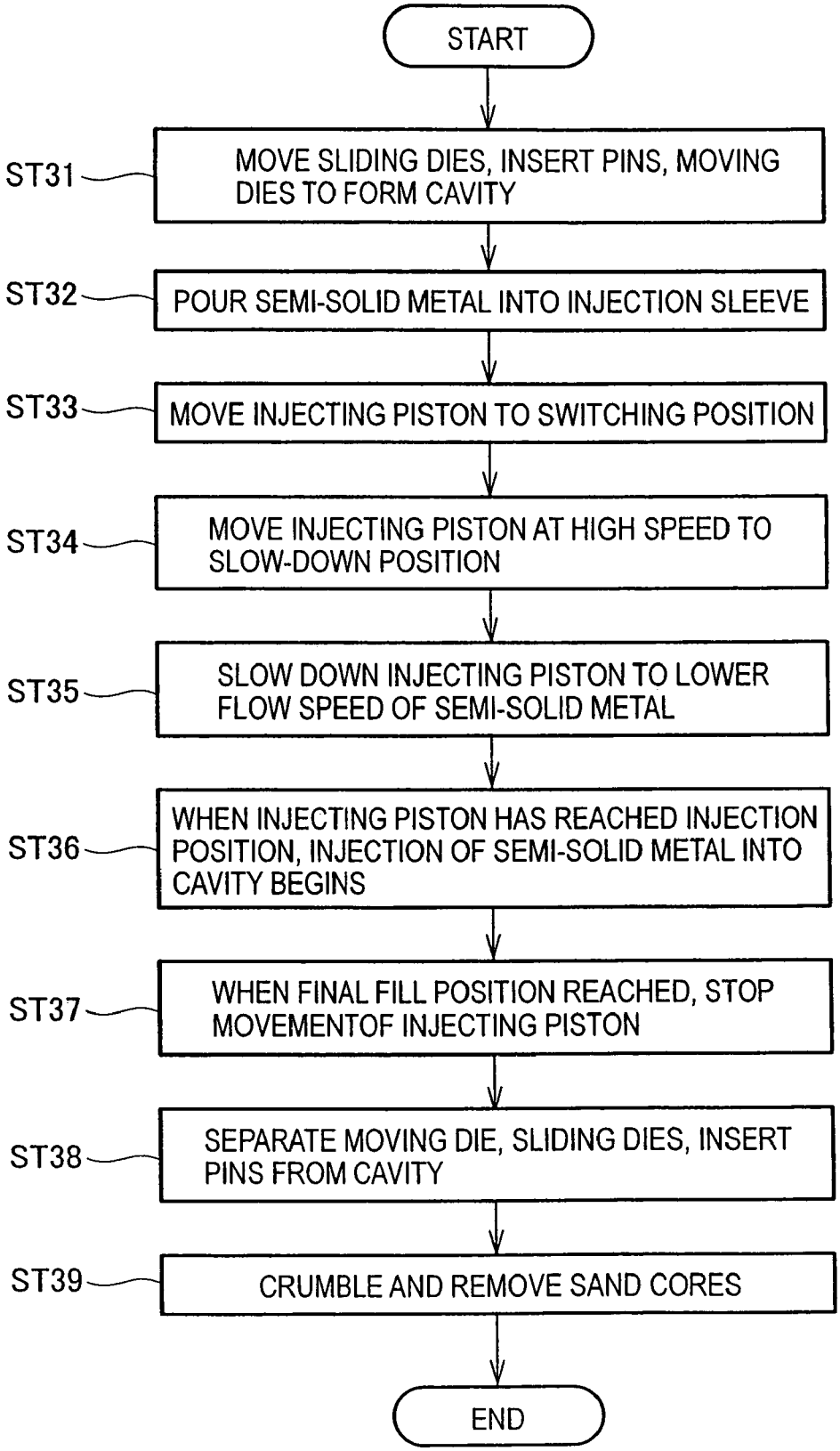
FIG. 30 is a flow chart showing the procedure of a die casting method according to a form of the invention.
Figure 31:
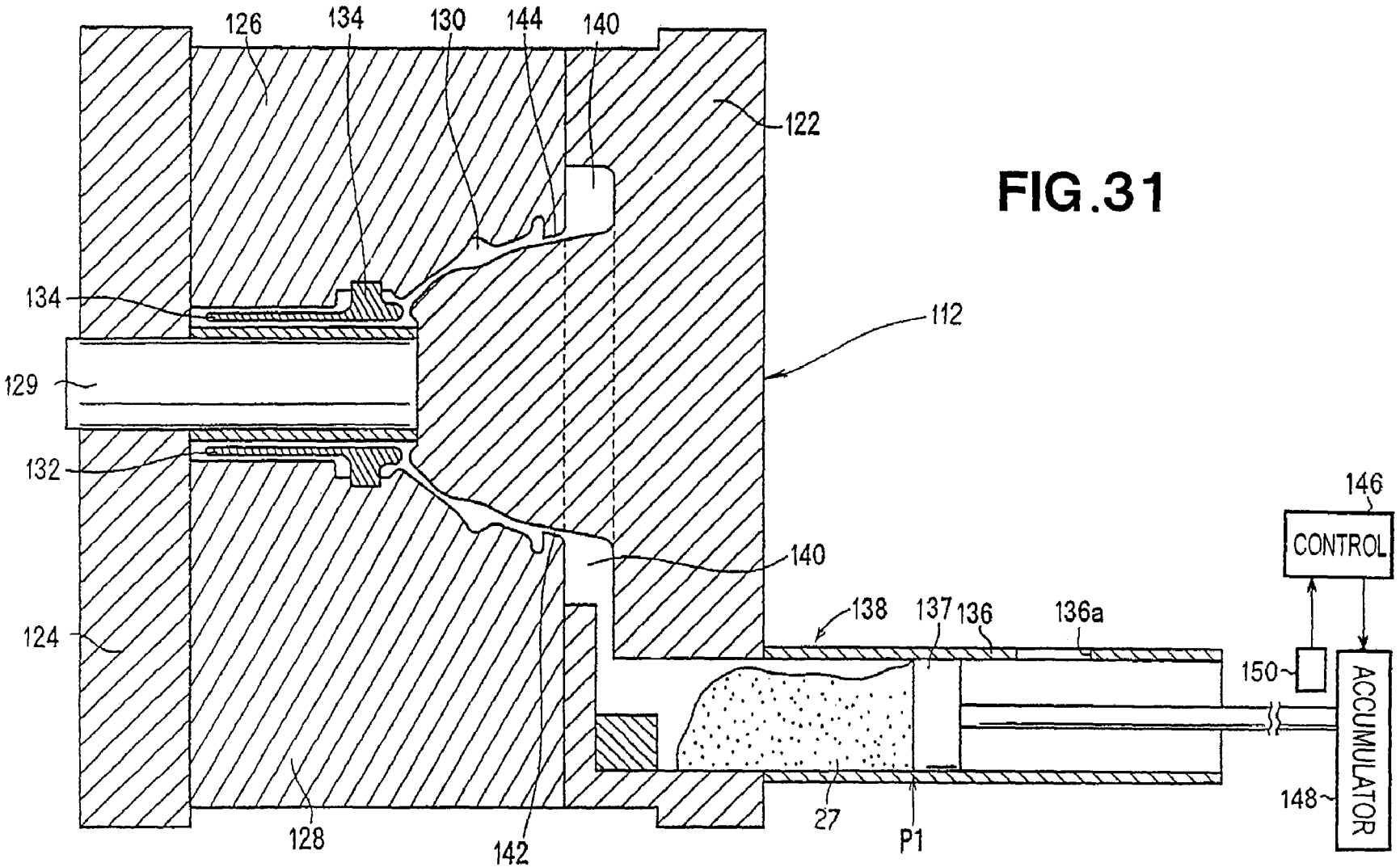
FIG. 31 is a sectional side view showing a casting mold with an injection piston moved to a switching position.
Figure 32:
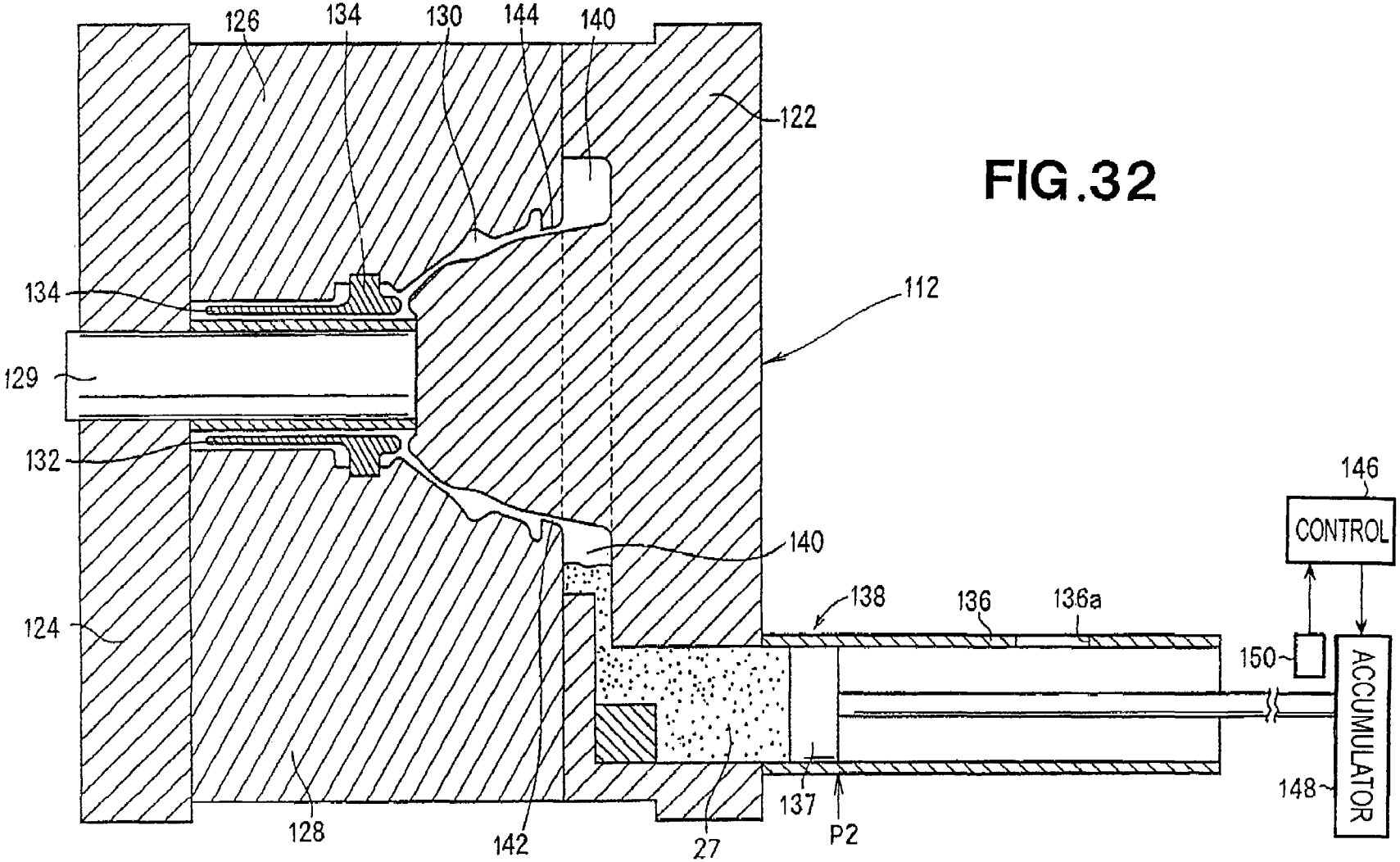
FIG. 32 is a sectional side view showing the casting mold with the injection piston moved to a slow-down position.

Next, a procedure for casting a cylinder block 110 using a casting mold 112 constructed like this will be described, with reference to FIG. 30. In the following description, processing is executed in the order of the step numbers shown.

ST31: (see also FIG. 29) First, the sliding dies 126, 128 are made to slide toward the center, and the moving die 124 is made to abut with the sliding dies 126, 128 to form the cavity 130. The insert pins 129 are moved to a predetermined position.

ST32: (see also FIG. 29) A predetermined amount of an aluminum alloy semi-solid metal 27 made in advance is fed into the injection sleeve 136 through the opening 136*a* by predetermined feeding means. The semi-solid metal 27 has been viscosity-managed so that good run is obtained. At this time, the injecting piston 137 is standing by at a starting position P0 on the accumulator 148 side of the opening 136*a*.

ST33: (see also FIG. 31) Under the action of the control part 146 the injecting piston 137 is driven and moved to a switching position P1 in the direction of the cavity 130 at a low speed VL (see FIG. 33). As a result, the semi-solid metal 27 is moved to the vicinity of the gate 138 without bulging out through the opening 136*a*. The switching position P1 is set to a position closer to the cavity 130 than the opening 136*a*.

ST34: (see also FIG. 31) The injecting piston 137 is accelerated to a high speed VH (see FIG. 33), and the semi-solid metal 27 is forced at high speed into the gate 138 and the runner 140. Because the injecting piston 137 is moved at a high speed like this the semi-solid metal 27 is injected in a short time, and there is no dropping of its runability due to hardening or temperature decrease. And, because the injection operation is carried out in a short time, a shortening of the cycle time can be achieved, and the work efficiency increases.

ST35: (see also FIG. 32, FIG. 34) When the injecting piston 137 has reached a slow-down position P2, under the action of the control part 146 the speed of the injecting piston 137 is reduced to the speed VL (see FIG. 33), and the flow speed of the semi-solid metal 27 is thereby lowered. The slow-down position P2 is set as a point before the leading end of the semi-solid metal 27 enters the cavity 130 and is stored in the control part 146. Specifically, the slow-down position P2 should be set to a position about 90 to 97% with respect to an injection position P3 of the injecting piston 137 at the point when the semi-solid metal 27 first starts to enter the cavity 130.

Figure 33:
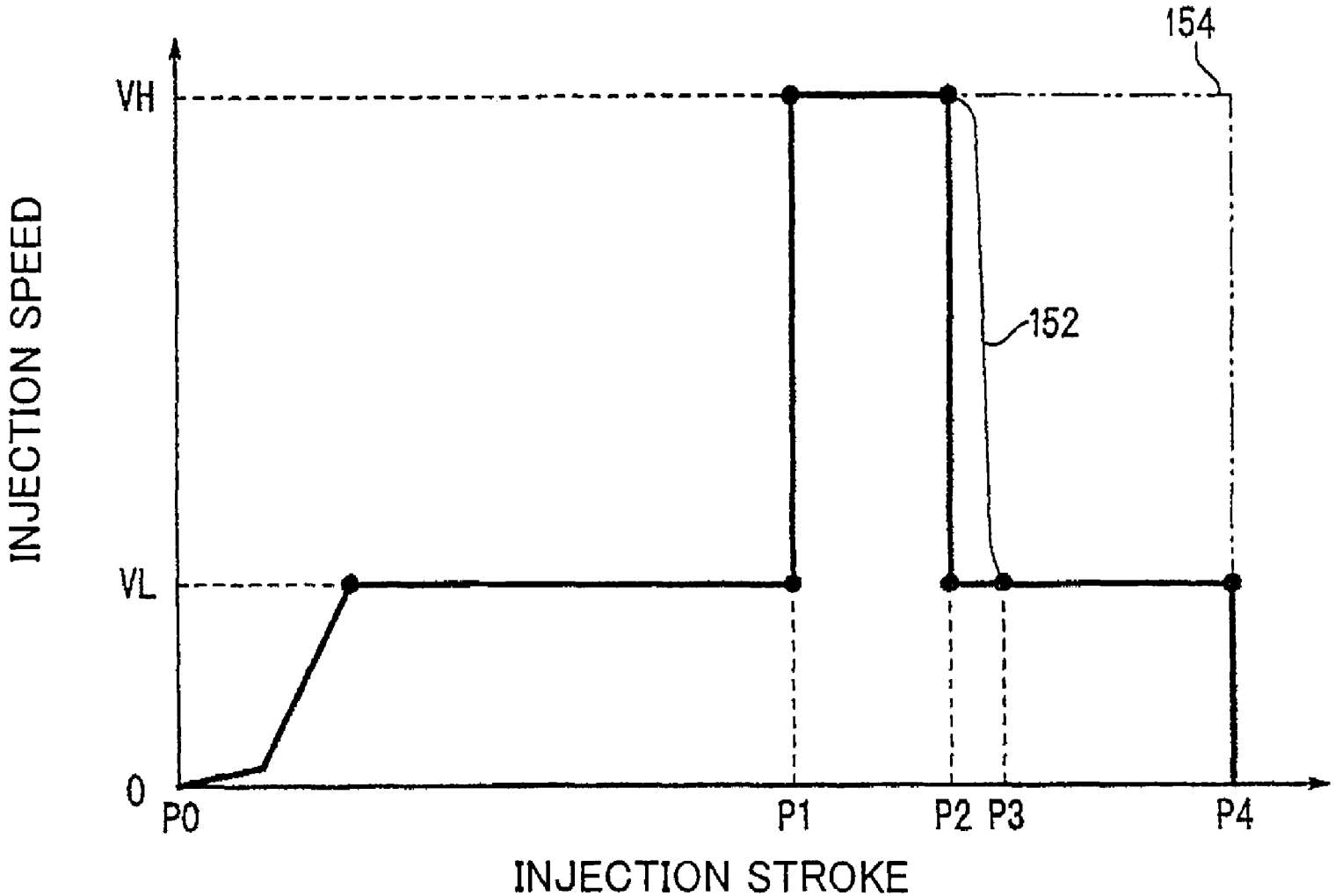
FIG. 33 is a graph showing an injecting piston speed and an average flow speed of semi-solid metal.

As shown in FIG. 33, until the injecting piston 137 reaches this slow-down position P2 the semi-solid metal 27 flows at the high speed VH, and because it has a large inertial force it does not decelerate suddenly but rather slows down gently as shown by the curve 152, which shows average flow speed. In the section between the slow-down position P2 and the injection position P3, the line showing the speed of the injecting piston 137 is made a thick line and the curve 152 showing the average flow speed of the semi-solid metal 27 is made a thin line to distinguish them. Because the semi-solid metal 27 has the properties of a liquid, its flow speed differs with location in correspondence with the cross-sectional area of the flow passage, and the curve 152 expressing the average flow speed shows the average value.

ST36: (see also FIG. 34) When the injecting piston 137 has reached the injection position P3, the semi-solid metal 27 has reached the weir 142 near to the gate 138 and starts to be injected into the cavity 130. The injection position P3 is set as the position of the injecting piston 137 when the semi-solid metal 27 first starts to be forced into the cavity 130, and the semi-solid metal 27 need not have reached the weir 144 farther from the gate 138, of the two weirs 142, 144.

When the injecting piston 137 has reached the injection position P3, the flow speed of the semi-solid metal 27 is slowed and becomes roughly equal to the speed VL. After this, by the injecting piston 137 continuing to be moved at the speed VL (see FIG. 33), the semi-solid metal 27 is injected into the cavity 130. Because the semi-solid metal 27 has an optimal viscosity there is little entrainment of gas, and furthermore because the temperature decrease from when it was poured into the injection sleeve 136 is small its runability is good and it fills the cavity 130 optimally. And, because the temperature decrease is small, the viscosity of the semi-solid metal 27 does not become excessively high, and the sand cores 132, 134 do not readily break.

At this time, if the semi-solid metal 27 were to be injected with its average flow speed maintained at the speed VH, as shown with a virtual line 154 in FIG. 33, because the sand cores 132, 134 are thin and moreover are formed so that they can be crumbled for easy removal, there would be a risk of them being broken by the high-viscosity semi-solid metal 27 impacting them.

With respect to this, in the die casting method of this embodiment, although the semi-solid metal 27 injected into the cavity 130 has a higher viscosity than other melts, because its flow speed is the low speed VL, there is no risk of the sand cores 132, 134 breaking.

And, when the semi-solid metal 27 is being injected into the cavity 130, by the cavity 130 being vacuum-evacuated or reduced in pressure, a high-quality cylinder block 110 having still less nesting and oxidation can be obtained.

ST37: As shown in FIG. 33, when it has reached a final fill point P4 the semi-solid metal 27 fills the cavity 130 and is pressurized, and the advancing movement of the injecting piston 137 stops. At this time, the semi-solid metal 27 has completely filled the cavity 130 through the weirs 142, 144, and excess semi-solid metal 27 has been discharged through the vent parts.

ST38: After the semi-solid metal 27 has fully cooled and hardened, the moving die 124, the sliding dies 126, 128 and the insert pins 129 are separated from the cavity 130. As a result, a cylinder block 110 of the kind shown in FIG. 28 and some unwanted parts not shown are formed. The unwanted parts are formed integrally with the cylinder block 110 as parts corresponding to the gate 138, the runner 140, the weirs 142, 144 shown in FIG. 29 and the vent parts, and by a predetermined procedure these unwanted parts are removed to obtain a cylinder block 110.

Figure 34:
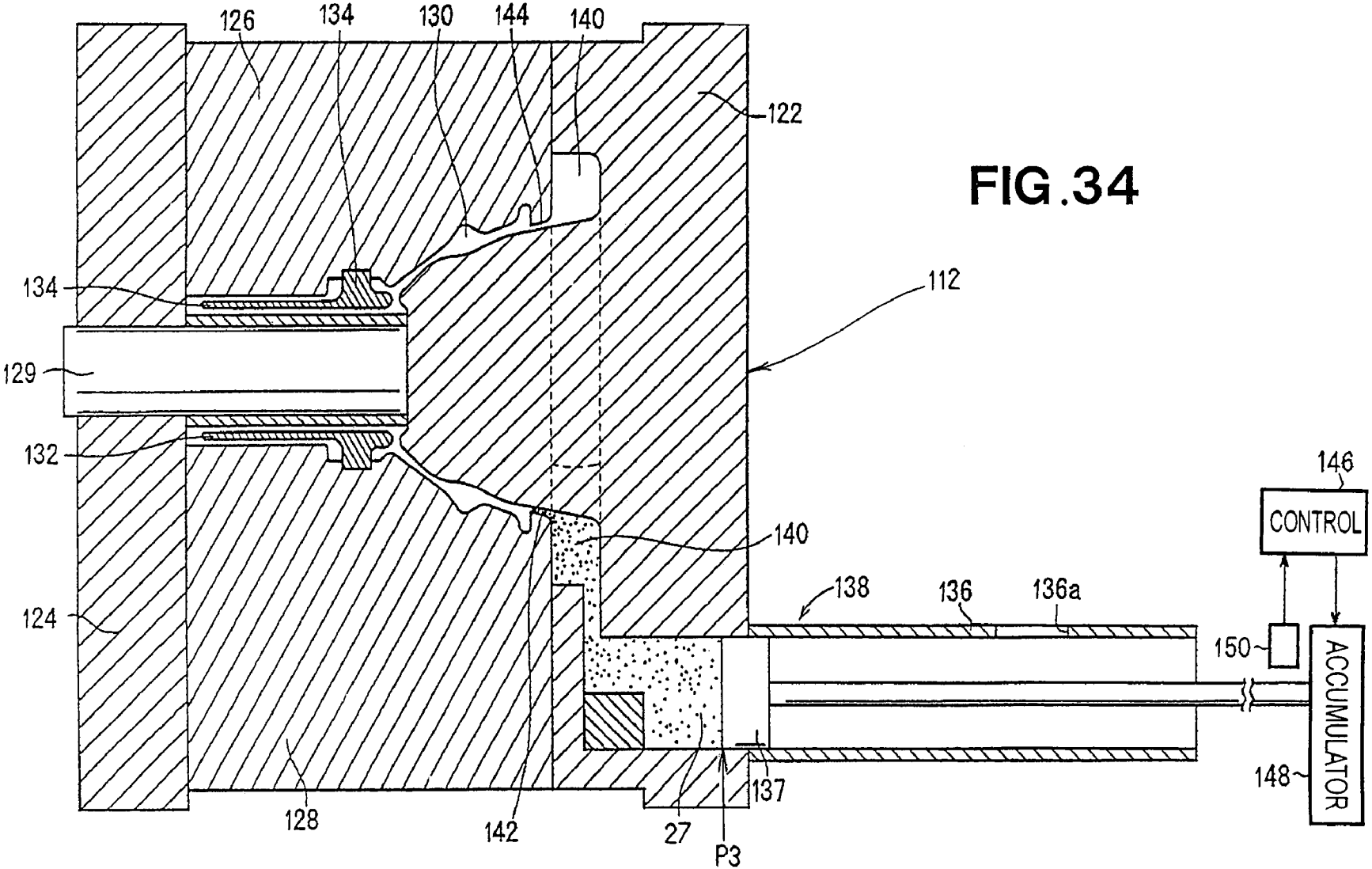
FIG. 34 is a sectional side view showing the casting mold with the injecting piston moved to an injecting position.
Figure 35:
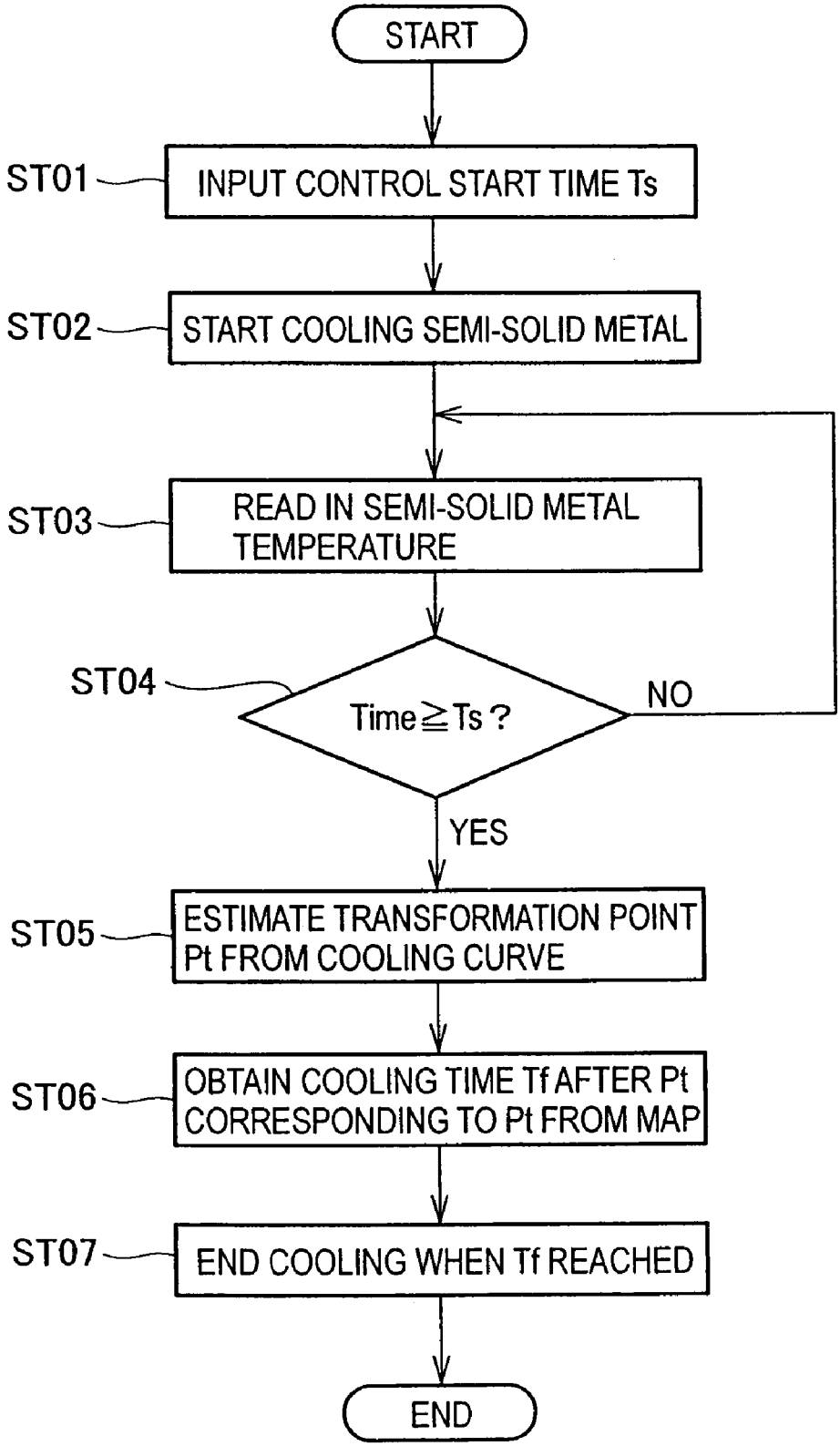
FIG.35 (Prior Art)
FIG. 35 is a flow chart showing a method of obtaining a target solid phase percentage of a semi-solid metal in related art.
Figure 36:
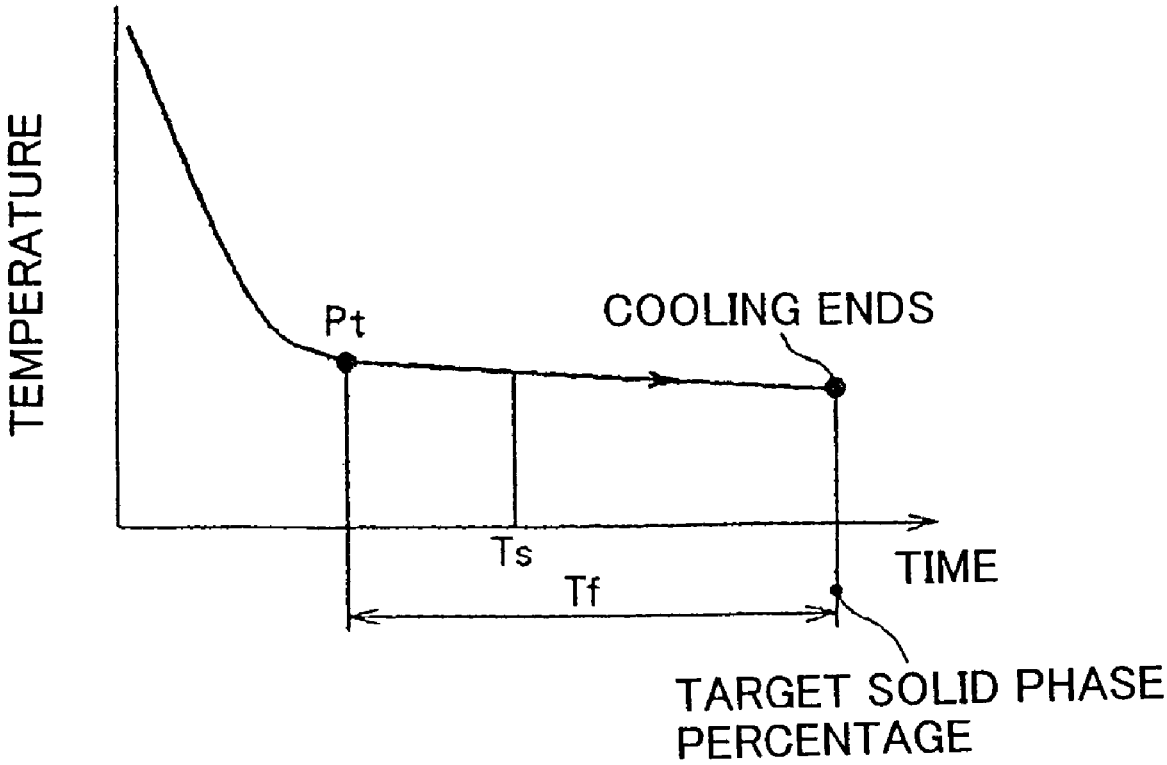
FIG.36 (Prior Art)
FIG. 36 is a graph showing a method of obtaining a target solid phase percentage of a semi-solid metal in related art.
Figure 37:
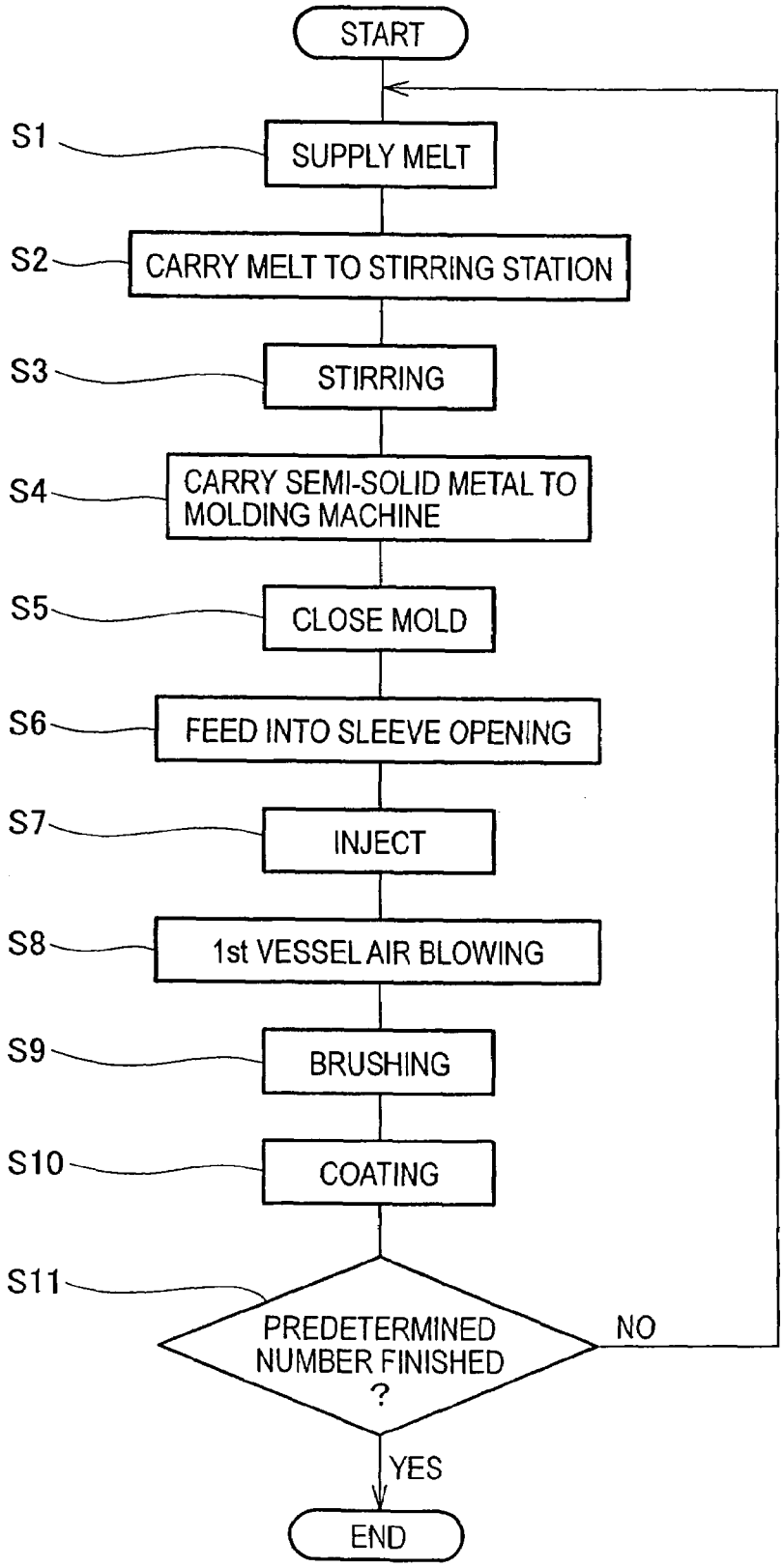
FIG.37 (Prior Art)
FIG. 37 is a flow chart showing an injection-molding method using a semi-solid metal in related art.

ST39: By air or sand blasting or blasting with a water jet, the sand cores 132, 134 shown in FIG. 34 are removed from the cylinder block 110 to form the water jacket 120 (see FIG. 28).

As described above, with a die casting method according to the present embodiment, it is possible to suppress the occurrence of nesting by using a semi-solid metal 27 as a casting material. Because the semi-solid metal 27 is slowed down before being injected into the cavity 130, it does not break the sand cores 132, 134, and it is not necessary for the sand cores 132, 134 to be made excessively strong. Also, because the semi-solid metal 27 moves at a high speed in a short time as far as just before it is injected into the cavity 130, deterioration in its runability due to temperature decrease can be prevented.

A die casting method according to the present invention is not limited to the embodiment described above, and various changes can of course be made within the scope of the invention.

INDUSTRIAL APPLICABILITY

In this invention, the management accuracy of the solid phase percentage of a semi-solid metal is raised, restoring treatment of vessels and stirring means used for a semi-solid metal is carried out with certainty, variation in the stirring time of a semi-solid metal is suppressed, and the method of injection of a semi-solid metal into a cavity is improved, whereby quality improvement and productivity improvement of a die cast product are achieved. Accordingly, the invention is suitable for the production of metal moldings of aluminum alloy and the like.

The invention claimed is:

1. A metal molded product production line comprising:

a semi-solid metal producing apparatus for producing a slurry-form semi-solid metal by stirring and cooling a melt contained in a vessel with stirring means having a cooling metal and a viscosity measuring probe immersed in the semi-solid metal, wherein the stirring means is moved horizontally through the semi-solid metal to stir the semi-solid metal and to measure a viscosity of the semi-solid metal; and a stirring means restoring apparatus for, after the production of the semi-solid metal, carrying out a predetermined restoring treatment on the stirring means, wherein a horizontal force exerted on the viscosity measuring probe as the stirring means is moved through the semi-solid metal is used to measure the viscosity of the semi-solid metal.

2. The metal molded product production line of claim 1, wherein the vessel is adapted to receive a predetermined amount of the melt, and the line further comprises:

a molding machine for molding a metal molded product with the semi-solid metal as a starting material;

a carrying apparatus for carrying the vessel from the semi-solid metal production apparatus to the molding machine and feeding the semi-solid metal in the vessel into the molding machine; and a vessel restoring apparatus for carrying out a predetermined restoring treatment on the vessel emptied by the feeding of the semi-solid metal into the molding machine.

3. The metal molded product production line of claim 1, wherein the semi-solid metal production apparatus includes an apparatus for measuring a viscosity of the semi-solid metal, the viscosity measuring apparatus comprising:

the stirring means for stirring the slurry-form semi-solid metal in the vessel;

the probe being in the form of a cantilever beam and having a lower part immersed in the semi-solid metal;

probe moving means for moving the probe;

a load cell for measuring a force that the probe receives from the semi-solid metal; and converting means for converting the force detected by the load cell to a viscosity of the semi-solid metal.

4. The metal molded product production line of claim 3, wherein the stirring means restoring apparatus comprises:

cooling means for cooling the cooling metal and the probe of the stirring means by dipping them in water;

coating means for applying a releasing agent to the cooling metal and the probe; and scraping means for scraping off, before the treatment with the cooling means, semi-solid metal adhered to the probe, the cooling means having a space compartment for receiving the probe and adapted to prevent entry of water therein, a first dipping part for dipping the cooling metal only, and a second dipping part for dipping at least the probe.

5. The metal molded product production line of claim 2, wherein the vessel restoring apparatus comprising:

air blowing means for removing adhered metal inside the vessel while cooling the vessel by blowing air into the vessel;

coating means for applying a releasing agent to the inside of the vessel; and scraping means for, prior to treatment by the air blowing means, scraping off semi-solid metal adhered to the inside of the vessel.

6. The metal molded product production line of claim 5, wherein the scraping means comprises a scraper installed in a fixed position, the carrying apparatus comprises a multiple-joint robot, and the movement of the robot is controlled such that while gripped by the robot the vessel emptied by the feeding of the semi-solid metal into the molding machine is moved relative to the scraper to scrape off semi-solid metal adhered to the inside of the vessel.

7. The metal molded product production line of claim 1, wherein the semi-solid metal producing apparatus comprises an apparatus for measuring a viscosity of the semi-solid metal, the viscosity measuring apparatus comprising:

the stirring means for stirring the slurry-form semi-solid metal held in the vessel;

the measuring probe in the form of a cantilever beam having a lower part to be immersed in the semi-solid metal;

means for moving the measuring probe;

a load cell for measuring a force that the measuring probe receives from the semi-solid metal; and converting means for converting the force detected by the load cell to a viscosity of the semi-solid metal, the stirring means restoring apparatus comprising:

cooling means for cooling the cooling metal and the probe of the stirring means by dipping them in water;

coating means for applying a releasing agent to the cooling metal and the probe; and means for scraping off, before the cooling treatment with the cooling means is carried out, the semi-solid metal adhered to the probe, the cooling means having a space compartment designed not to allow entry of water for receiving the probe, a first dipping part for dipping the cooling metal only, and a second dipping part for dipping at least the probe, so that the restoring treatment is carried out on the stirring means prior to the stirring of the slurry-form semi-solid metal.

8. The metal molded product production line of claim 2, wherein the vessel restoring apparatus comprises:

air blowing means for blowing air into the vessel to remove adhered metal inside the vessel and cool the vessel;

coating means for applying a releasing agent to the inside of the vessel; and scraping means for scraping off, before the air blowing treatment by the air blowing means, the semi-solid metal adhered to the inside of the vessel, so that after the vessel is emptied by feeding the slurry-form semi-solid metal into the molding machine, the vessel is cooled for a predetermined time while removing adhered metal inside the vessel, to make the vessel ready for a succeeding pouring of the melt from the melt holding furnace, the predetermined time of the vessel cooling is determined on a basis of a temperature of the melt holding furnace and a temperature of the emptied vessel.

9. The metal molded product production line of claim 1, wherein the stirring means is moved horizontally through the semi-solid metal along a path corresponding to a shape of the vessel.

10. The metal molded product production line of claim 9, wherein the stirring means comprises the cooling metal and the viscosity measuring probe, the cooling metal and viscosity measuring probe being integral with one another and moved simultaneously along the path.

11. The metal molded product production line of claim 9, wherein the cooling metal and the viscosity measuring probe are structurally separate from each other and are independently movable along different paths.

12. A metal molded product production method comprising the steps of:

producing a slurry-form semi-solid metal by stirring and cooling a melt contained in a vessel with stirring means having a cooling metal and a viscosity measuring probe immersed in the melt, wherein stirring comprises moving the stirring means horizontally through the melt and viscosity measuring comprises detecting a force exerted on an immersed portion of the viscosity measuring probe as the stirring means is moved horizontally through the melt; and after the production of the semi-solid metal, carrying out a predetermined restoring treatment on the stirring means.

13. The metal molded product production method of claim 12, further comprising the steps of:

after a predetermined amount of the melt is poured from a melt holding furnace into the vessel and the semi-solid metal is produced in the vessel, carrying the vessel from a semi-solid metal producing apparatus to a molding machine so as to feed the semi-solid metal contained in the vessel to the molding machine; and molding a metal molded product with the semi-solid metal as a starting material.

14. The metal molded product production method of claim 12, further comprising the step of managing a solid phase percentage of the semi-solid metal, the solid phase percentage management step comprising the steps of:

before the semi-solid metal producing step, preparing a map expressing a correlation between the solid phase percentage and viscosity of the slurry-form semi-solid metal for a given metal composition;

setting a target viscosity corresponding to a target solid phase percentage using the map;

during the semi-solid metal producing step, measuring the viscosity of the semi-solid metal in the vessel while cooling the metal; and carrying out the cooling until the viscosity reaches the target viscosity, whereby the solid phase percentage of the semi-solid metal is made to match the target solid phase percentage.

15. The metal molded product production method of claim 14, wherein the stirring means restoring step comprises the step of: cooling the cooling metal and the probe of the stirring means by dipping the cooling metal and probe in water; and applying a releasing agent to the cooling metal and the probe, wherein the stirring means restoring step further comprises, before the cooling step, the step of scraping off the semi-solid metal adhered to the probe, and wherein the cooling step comprises a first step of dipping in water the cooling metal only and a second step of dipping in water at least the probe, the second dipping step being set to last shorter than the first dipping step.

16. The metal molded product production method of claim 13, further comprising the step of, after the vessel is emptied by feeding the slurry-form semi-solid metal held therein into the molding machine, cooling the vessel for a predetermined time to make the vessel ready for a succeeding pouring of the melt from the melt holding furnace, the predetermined time of the vessel cooling step is determined in correspondence with a temperature of the melt holding furnace and a temperature of the emptied vessel.

17. The metal molded product production method of claim 13, wherein the molding step comprises a die-casting step including the steps of: causing an injecting piston to inject the slurry-form semi-solid metal from a gate; and injecting, via a runner and a weir, the semi-solid metal into a cavity with a sand core disposed therein to thereby provide a cast molding, and wherein the molding step further comprises the step of, before a leading end of the semi-solid metal enters into the cavity, slowing down the piston to reduce a rate of flow of the semi-solid metal.

18. The metal molded product production method of claim 17, wherein the die-casting step comprises causing the injecting piston to slow down at a position 90 to 97% of the way from the injection start position of the injecting piston to the position of the injecting piston when the semi-solid metal first starts to enter the cavity.

19. The metal molded product production method of claim 17, wherein the cast article comprises a cylinder block of an engine, and after the casting step the sand core is removed to thereby provide a cooling water jacket.

20. The metal molded product production method of claim 12, further comprising the steps of: managing a solid phase percentage of the semi-solid metal; and restoring the stirring means, the solid phase percentage management step comprising the steps of:

before the semi-solid metal producing step, preparing a map expressing a correlation between the solid phase percentage and viscosity of the slurry-form semi-solid metal for a given metal composition;

setting a target viscosity corresponding to a target solid phase percentage using the map;

during the semi-solid metal producing step, measuring, by means of the measuring probe of the stirring means, with a lower part thereof inserted into the semi-solid metal, the viscosity of the semi-solid metal in the vessel while cooling the semi-solid metal by means of the cooling metal of the stirring means; and carrying out the cooling until the viscosity reaches the target viscosity, the stirring means restoring step comprising the steps of:

before the semi-solid metal producing step, cooling the cooling metal and the measuring probe of the stirring means by dipping them in water; and applying a releasing agent to the cooling metal and the measuring probe, the stirring means restoring step further comprising, before the cooling step, the step of scraping off the semi-solid metal adhered to the probe, the cooling step comprising a first step of dipping in water the cooling metal only and a second step of dipping in water at least the probe, the second dipping step being set to last shorter than the first dipping step, whereby the solid phase percentage of the semi-solid metal is made to match the target solid phase percentage.

21. The metal molded product production method of claim 12, wherein stirring is carried out by moving the stirring means horizontally through the semi-solid metal along a path corresponding to a shape of the vessel.

22. The metal molded product production method of claim 21, wherein the stirring means comprises the cooling metal and the viscosity measuring probe, the cooling metal and the viscosity measuring probe being integral with one another and moved simultaneously along the path.

23. The metal molded product production method of claim 21, wherein the cooling metal and the viscosity measuring probe are structurally separate from each other and are independently movable along different paths.

* * * * *